US006431675B1

(12) United States Patent
Chang

(10) Patent No.: US 6,431,675 B1
(45) **Date of Patent: *Aug. 13, 2002**

(54) METHOD OF DRIVING AN INK JET PRINTHEAD

(75) Inventor: Junhua Chang, Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/285,650

(22) Filed: Apr. 5, 1999

(30) Foreign Application Priority Data

| | | |
|---|---|---|
| Apr. 3, 1998 | (JP) | 10-091792 |
| Sep. 4, 1998 | (JP) | 10-251098 |
| Mar. 30, 1999 | (JP) | 11-090283 |

(51) Int. Cl.[7] ..... B41J 29/38; B41J 2/045

(52) U.S. Cl. ..... 347/10; 347/9; 347/11; 347/68

(58) Field of Search ..... 347/9, 10, 11

(56) References Cited

U.S. PATENT DOCUMENTS 6,095,630 A * 8/2000 Horii et al. ..... 347/10

FOREIGN PATENT DOCUMENTS

| | | | |
|---|---|---|---|
| EP | 0 841 164 A1 * | 5/2001 | |
| JP | 63-71355 | 3/1988 | ..... B41J/3/04 |
| JP | 7-76087 | 3/1995 | ..... B41J/2/045 |
| JP | 10157100 | 6/1998 | ..... B41J/2/045 |
| JP | 5318731 | 12/1998 | ..... B41J/2/045 |
| WO | WO97/37852 | 10/1997 | ..... B41J/2/045 |

* cited by examiner

*Primary Examiner*—John Barlow
*Assistant Examiner*—Al Dudding
(74) *Attorney, Agent, or Firm*—Sughrue Mion, PLLC

(57) ABSTRACT

Disclosed is a method of driving an ink jet printhead having flexural or longitudinal vibration mode piezoelectric elements. The method includes a contracting step for expanding the pressure generating chamber until a velocity of the trailing edge of the ejected ink drop is substantially zero at a position near the nozzle orifice. The printhead ejects an ink drop having small volume without a reduction in ink drop velocity.

31 Claims, 14 Drawing Sheets

FIG. 5 (a1)
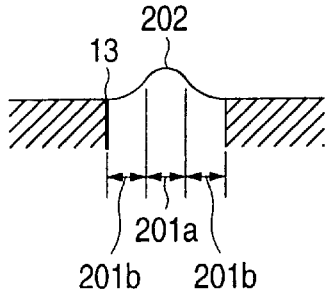
FIG. 5 (a2)
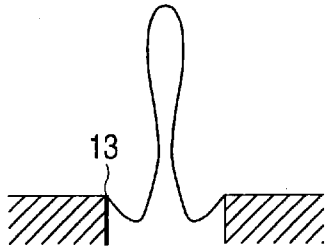
FIG. 5 (a3)
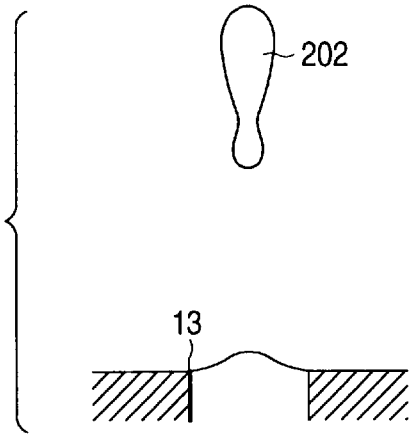
FIG. 5 (b)
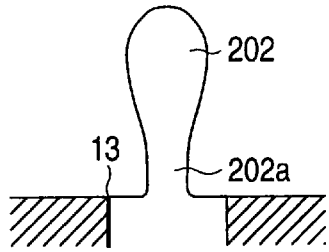

METHOD OF DRIVING AN INK JET PRINTHEAD

BACKGROUND OF THE INVENTION

1. Field of the Invention

The present invention relates to a method of driving an ink jet printhead in which a part of a pressure generating chamber, which communicates with a nozzle orifice for ejecting an ink drop, is formed with a vibration plate, a piezoelectric layer is formed on the surface of the vibration plate, and an ink drop is ejected from the nozzle orifice by a displacement of the piezoelectric layer.

2. Description of the Related Art

There is known an ink jet printhead in which a part of a pressure generating chamber, which communicates with a nozzle orifice for ejecting an ink drop, is formed with a vibration plate. The piezoelectric element deforms the vibration plate to pressurize ink within the pressure generating chamber, and to eject ink through in the form of an ink drop through the nozzle orifice. This printhead is classified into two printheads. A first printhead uses a piezoelectric actuator in which a piezoelectric element generates a longitudinal vibration mode in the axial direction of the actuator. A second printhead uses a piezoelectric actuator in which a piezoelectric element generates a flexural vibration around the axis.

In the first printhead, a volume of the pressure generating chamber may be varied by bringing the end face of the piezoelectric element into contact with the vibrating plate. An advantage of the first printhead is that it can be manufactured so as to be suitable for high density printing. This printhead suffers from the following disadvantage. It is necessary to form a piezoelectric green sheet into a comb-shape of piezoelectric elements by cutting in conformity with the pitches of the orifice array, and 2) to position the comb-shaped piezoelectric elements to the pressure generating chambers and fasten them thereonto. Therefore, the manufacturing process of the printhead is intricate.

The second printhead is manufactured by a relatively easy process of shaping a piezoelectric green sheet in conformity with the pressure generating chambers and pasting the thus shaped green sheet onto the chamber, and sintering the resultant.

The second printhead requires a larger displacement area than that of the first printhead, and hence a large volume of the pressure generating chamber. As a result, an ejected ink drop is large in volume. In this respect, where the second printhead is used, it is difficult to form dots of small size, which are essential to graphic printing. A possible approach to solve the problem is to reduce the amount of ejecting ink by lessening a displacement of the flexural type piezoelectric actuator. The approach is disadvantageous in that the ink ejecting pressure is low, the ink ejecting speed is low, the ejected ink drop lands at an incorrect position. Further, degradation of the print quality is noticeable particularly in the printing of the type in which an exact dot printing is required, for example, graphic printing.

To cope with this, there is proposed a drive method in JP-A-63-71355. In this method, the ink drop is ejected from the nozzle orifice by contracting the pressure generating chamber after the ink ejection, and then the pressure generating chamber is expanded again to absorb the tail of the ink drop, whereby the ink drops secondarily formed are removed. However, the ink drop per se is not reduced in this method.

There is another proposal (JP-A-7-76087) in which after expanded, the pressure generating chamber is contracted at a first contracting rate and then at a second contracting rate lower than the first one, to thereby reduce the length between the leading and trailing ends of the ink drop or a time difference therebetween as short as possible and to form spherical ink dots.

A recent marked trend of high definition printing needs ink drops of extremely small size, while high speed printing needs ink drops of large volume. Further, high speed and stable driving of the printhead is also desired.

SUMMARY OF THE INVENTION

Accordingly, an object of the present invention is to provide a method of driving an ink jet printhead which reduces a volume of an ink drop without lowering traveling speed of the ink drop, and is suitable for graphic printing.

A first mode of the invention is a method of driving an ink jet printhead in which when one of piezoelectric vibrators each associated with a pressure generating chamber, which communicatively connects to an orifice and a reservoir, both being associated with the pressure generating chamber, is driven, the pressure generating chamber associated with the driven piezoelectric vibrator is expanded or contracted to eject an ink drop through the nozzle orifice associated with the driven pressure generating chamber. The method includes: a contracting step for ejecting an ink drop through the nozzle orifice by contracting the pressure generating chamber; and an expanding step for expanding the pressure generating chamber till a velocity of the trailing end of the ejected ink drop is substantially 0 at a position near the nozzle orifice.

In the first mode of the invention, the pressure generating chamber starts to expand before the ejection of an ink drop that is about to discharge as the result of its contraction in the contraction step is completed. Only the portion of ink having been about to discharge is ejected in the form of an ink drop. A volume of the ink drop can be controlled depending on an expansion start timing.

A second mode of the invention, based on the first mode, is a method of driving an ink jet printhead in which an expansion of the pressure generating chamber in the expanding step following the contracting step starts after a time point where the meniscus of ink in the nozzle orifice starts to be deformed to form the leading edge of an ink drop to be ejected through the nozzle orifice.

In the second mode, the leading end of an ink drop is ejected at an instant that the pressure generating chamber starts to expand in the expanding step.

A third mode of the invention, based on the mode 1 or 2, is a method of driving an ink jet printhead in which an expansion period of the expanding step is no more than ¼ Tc, wherein Tc is the Helmholtz frequency of the pressure generating chamber.

The third mode can most effectively hold back the retraction of the meniscus, which follows the ink drop ejection.

A fourth mode of the invention is a method of driving an ink jet printhead in which when one of piezoelectric vibrators each associated with a pressure generating chamber, which communicatively connects to an orifice and a reservoir, both being associated with the pressure generating chamber, is driven, the pressure generating chamber associated with the driven piezoelectric vibrator is expanded or contracted to eject an ink drop through the nozzle orifice associated with the driven pressure generating chamber. The method includes: a contracting step for ejecting an ink drop through the nozzle orifice by contracting the pressure generating chamber; and an expanding step for expanding the pressure generating chamber at such a timing as to reduce a volume of an ink drop to be ejected for a period being no more than ¼ Tc, wherein Tc is the Helmholtz frequency.

The fourth mode can control a volume of an ink drop in a manner that the pressure generating chamber is expanded for a predetermined time period before the ejection of an ink drop that is about to discharge as the result of its contraction in the contraction step is completed.

A fifth mode of the invention, based on any of the first to fourth modes, is a method of driving an ink jet printhead which further includes a hold step, following the contracting step, for holding the contraction state of the pressure generating chamber for a period being no more than ⅓ Tc, wherein Tc is the Helmholtz frequency of the pressure generating chamber.

The fifth mode can reduces the amount of an ink drop ejected by reducing the contraction holding period.

A sixth mode of the invention is a method of driving an ink jet printhead in which when one of piezoelectric vibrators each associated with a pressure generating chamber, which communicatively connects to an orifice and a reservoir, both being associated with the pressure generating chamber, is driven, the pressure generating chamber associated with the driven piezoelectric vibrator is expanded or contracted to eject an ink drop through the nozzle orifice associated with the driven pressure generating chamber. The drive method includes: a contracting step for ejecting an ink drop through the nozzle orifice by contracting the pressure generating chamber; a hold step for holding the contraction state of the pressure generating chamber for a period being no more than ⅓ Tc, wherein Tc is the Helmholtz frequency of the pressure generating chamber; and an expanding step for expanding the pressure generating chamber for a period being ¼ Tc wherein Tc is the Helmholtz frequency.

The sixth mode can control a volume of an ink drop in a manner that the pressure generating chamber is expanded for a predetermined time period before the ejection of an ink drop that is about to discharge as the result of its contraction in the contraction step is completed.

A seventh mode of the invention, based on the fifth or sixth mode, is a method of driving an ink jet printhead in which the holding time period of the hold step is no more than 3 microseconds.

The seventh mode can reduces the amount of an ink drop ejected by reducing the hold period between the waves of the drive signal.

An eighth mode of the invention, based on the fifth or sixth mode, is a method of driving an ink jet printhead in which the holding time period of the hold step is no more than 1 microsecond.

The ink drop ejection is stabilized and a ink drop volume is reduced by reducing the hold time between the waves of the drive signal.

A ninth mode of the invention, based on any of the first to eighth modes, is a method of driving an ink jet printhead further including a preparatory step, followed by the contraction step, for preparing the ejection of an ink drop by expanding the pressure generating chamber.

In the ninth mode, the pressure generating chamber is expanded before the contracting step to lower the meniscus level in the nozzle orifice in preparation for the ink drop ejection. Therefore, the ninth mode eject an ink drop of a large volume at high speed.

A 10th mode of the invention, based on any of the first to ninth modes, is a method of driving an ink jet printhead in which an expanding rate in the expanding step is larger than a contracting rate in the contracting step.

In this tenth mode, an expanding rate of the pressure generating chamber in the expanding step is increased, so that only the leading end of an ink drop which started to discharge is discharged. The result is to form an ink drop of a small volume.

An 11th mode, based on any of the first to tenth modes, is a method of driving an ink jet printhead in which an expansion-variation quantity in the expanding step is smaller than a contraction-variation quantity in the contracting step.

This mode ejects only the leading end of an ink drop which started to discharge by expanding the pressure generating chamber with its expansion-variation quantity smaller than that in the contracting step.

A 12th mode is a method of driving an ink jet printhead in which when one of piezoelectric vibrators each associated with a pressure generating chamber, which communicatively connects to an orifice and a reservoir, both being associated with the pressure generating chamber, is driven, the pressure generating chamber associated with the driven piezoelectric vibrator is expanded or contracted to eject an ink drop through the nozzle orifice associated with the driven pressure generating chamber, the method comprising: a first contracting step for ejecting an ink drop through a nozzle orifice by contracting a pressure generating chamber; a first expanding step for expanding the pressure generating chamber till a velocity of the trailing end of the ejected ink drop is substantially 0 at a position near the nozzle orifice; and a second contracting step for contracting the pressure generating chamber so as to reduce a retraction of the ink meniscus occurring after the expanding step is executed.

This mode produces a small ink drop volume, suppresses meniscus vibrations occurring after the drop ejection in preparation for the next ejection of an ink drop.

A 13th mode, based on the twelfth mode, is a method of driving an ink jet printhead in which an expansion of the pressure generating chamber in the first expanding step following the first contracting step starts after a time point where the meniscus of ink in the nozzle orifice starts to be deformed to form the leading edge of an ink drop to be ejected thought the nozzle orifice.

In this mode, the leading end of an ink drop ejects at the start of an expansion of the pressure generating chamber in the first expanding step.

A 14th mode, based on the twelfth or thirteenth mode, is a method of driving an ink jet printhead in which an expansion period of the first expanding step is ¼ Tc, wherein Tc is the Helmholtz frequency of the pressure generating chamber.

This mode effectively suppresses a retraction of the meniscus after the ink drop ejection.

A 15th mode is a method of driving an ink jet printhead in which when one of piezoelectric vibrators each associated with a pressure generating chamber, which communicatively connects to an orifice and a reservoir, both being associated with the pressure generating chamber, is driven, the pressure generating chamber associated with the driven piezoelectric vibrator is expanded or contracted to eject an ink drop through the nozzle orifice associated with the driven pressure generating chamber, the method comprising: a contracting step for ejecting an ink drop through the nozzle orifice by contracting the pressure generating chamber; an expanding step for expanding the pressure generating chamber at such a timing as to reduce a volume of an ink drop to be ejected for a period being ¼ Tc, wherein Tc is the Helmholtz frequency of the pressure generating chamber; and a second contracting step for contracting the pressure generating chamber so as to reduce a retraction of the ink meniscus occurring after the expanding step is executed.

This mode efficiently ejects an ink drop of a small volume, suppresses a retraction of the meniscus occurring after the ink drop ejection. Stable and high speed ejection of an ink drop is realized.

A 16th mode, based on any of the twelfth to fifteenth modes, is a method of driving an ink jet printhead further including a hold step, following the contracting step, for holding the contraction state of the pressure generating chamber for a period being no more than ⅓ Tc, wherein Tc is the Helmholtz frequency.

This mode efficiently ejects an ink drop of a small volume.

A 17th mode of the invention is a method of driving an ink jet printhead in which when one of piezoelectric vibrators each associated with a pressure generating chamber, which communicatively connects to an orifice and a reservoir, both being associated with the pressure generating chamber, is driven, the pressure generating chamber associated with the driven piezoelectric vibrator is expanded or contracted to eject an ink drop through the nozzle orifice associated with the driven pressure generating chamber, the method comprising: a first contracting step for ejecting an ink drop through the nozzle orifice by contracting the pressure generating chamber; a hold step for holding the contraction state of the pressure generating chamber for a period being no more than ⅓ Tc, wherein Tc is the Helmholtz frequency of the pressure generating chamber; a first expanding step for expanding the pressure generatin chamber for a period being no more than ¼ Tc, wherein Tc is the Helmholtz frequency of the pressure generating chamber; and a second contracting step for contracting the pressure generating chamber so as to reduce a retraction of the ink meniscus occurring after the expanding step is executed.

This mode efficiently ejects an ink drop of a small volume, suppresses a retraction of the meniscus occurring after the ink drop ejection. Stable and high speed ejection of an ink drop is realized.

An 18th mode of the invention, based on any of the twelfth to seventeenth modes, is a method of driving an ink jet further including a second expanding step, following the first expanding step, for expanding the pressure generating chamber so as to suppress vibrations of the meniscus after the ink drop ejection. This mode more effectively suppresses meniscus vibrations after the ink drop ejection in preparation for the next ink drop ejection.

A 19th mode, based on any of the twelfth to eighteenth modes, is a method of driving an ink jet printhead further including a preparatory step, followed by the first contraction step, for preparing the ejection of an ink drop by expanding the pressure generating chamber.

In this mode, the pressure generating chamber is expanded before the contracting step to lower the meniscus level in the nozzle orifice in preparation for the ink drop ejection. Therefore, the ninth mode eject an ink drop of a large volume at high speed.

A 20th mode of the invention, based on any of the 12th to 19th modes, is a method of driving an ink jet printhead in which the second contracting step starts during a time period ranging from a time point where the ink meniscus starts to retract after the leading edge of an ink drop departs from the nozzle orifice to a time point where the meniscus retracts to its full distance. This mode effectively suppresses a meniscus retraction after the ink drop ejection, providing a stable and high speed driving of the printhead.

A 21st mode of the invention, based on any of the 12th to 20th modes, is a method of driving an ink jet printhead in which a time period ranging from the start of the first contracting step to the start of the second contracting step is no more than Tc, wherein Tc is the Helmholtz frequency of the pressure generating chamber.

This mode effectively suppresses a meniscus retraction after the ink drop ejection, providing a stable and high speed driving of the printhead.

A 22nd mode, based on any of the 12th to 21st modes, is a method of driving an ink jet printhead in which a time period ranging from the start of the first contracting step to the start of the second contracting step is within a range of the period Tc of the Helmholtz frequency of the pressure generating chamber.

This mode more effectively suppresses a meniscus retraction after the ink drop ejection, providing a stable and high speed driving of the printhead.

A 23rd mode, based on any of the 12th to 22nd modes, is a method of driving an ink jet printhead in which the contraction periods of the pressure generating chamber in the first and second contracting steps are each no more than ½ Tc, wherein Tc is the Helmholtz frequency of the pressure generating chamber.

This mode effectively suppresses a meniscus retraction after the ink drop ejection, providing a stable and high speed driving of the printhead.

A 24th mode, based on any of the 12th to 23rd modes, is a method of driving an ink jet printhead in which the contraction period of the pressure generating chamber in the second contracting step is no more than ⅓ Tc, wherein Tc is the Helmholtz frequency of the pressure generating chamber.

This mode more effectively suppresses a meniscus retraction after the ink drop ejection, providing a stable and high speed driving of the printhead.

A 25th mode, based on any of the 12th to 24th modes, is a method of driving an ink jet printhead in which a time period ranging from the start of the first contracting step to the start of the second expanding step is no more than Tc, wherein Tc is the Helmholtz frequency of the pressure generating chamber.

This mode efficiently ejects an ink drop of a small volume.

A 26th mode, based on any of the 12th to 25th modes, is a method of driving an ink jet printhead in which the expansion period of the pressure generating chamber in the second expanding step is no more than ½ Tc, wherein Tc is the Helmholtz frequency of the pressure generating chamber.

This mode more efficiently ejects an ink drop of a small volume.

A 27th mode, based on any of the 12th to 26th modes, is a method of driving an ink jet printhead in which a time period from application of a drive signal in the first contracting step to application of the drive signal in the second expanding step is no more than Tc, wherein Tc is the Helmholtz frequency of the pressure generating chamber.

This mode efficiently ejects an ink drop of a small volume.

BRIEF DESCRIPTION OF THE DRAWINGS

FIGS. 5(*a*1)–(*a*3) and FIG. 5(*b*) are diagrams showing a transient process of the ink drop ejection.

DESCRIPTION OF THE PREFERRED EMBODIMENTS

Embodiment 1

Figure 1:
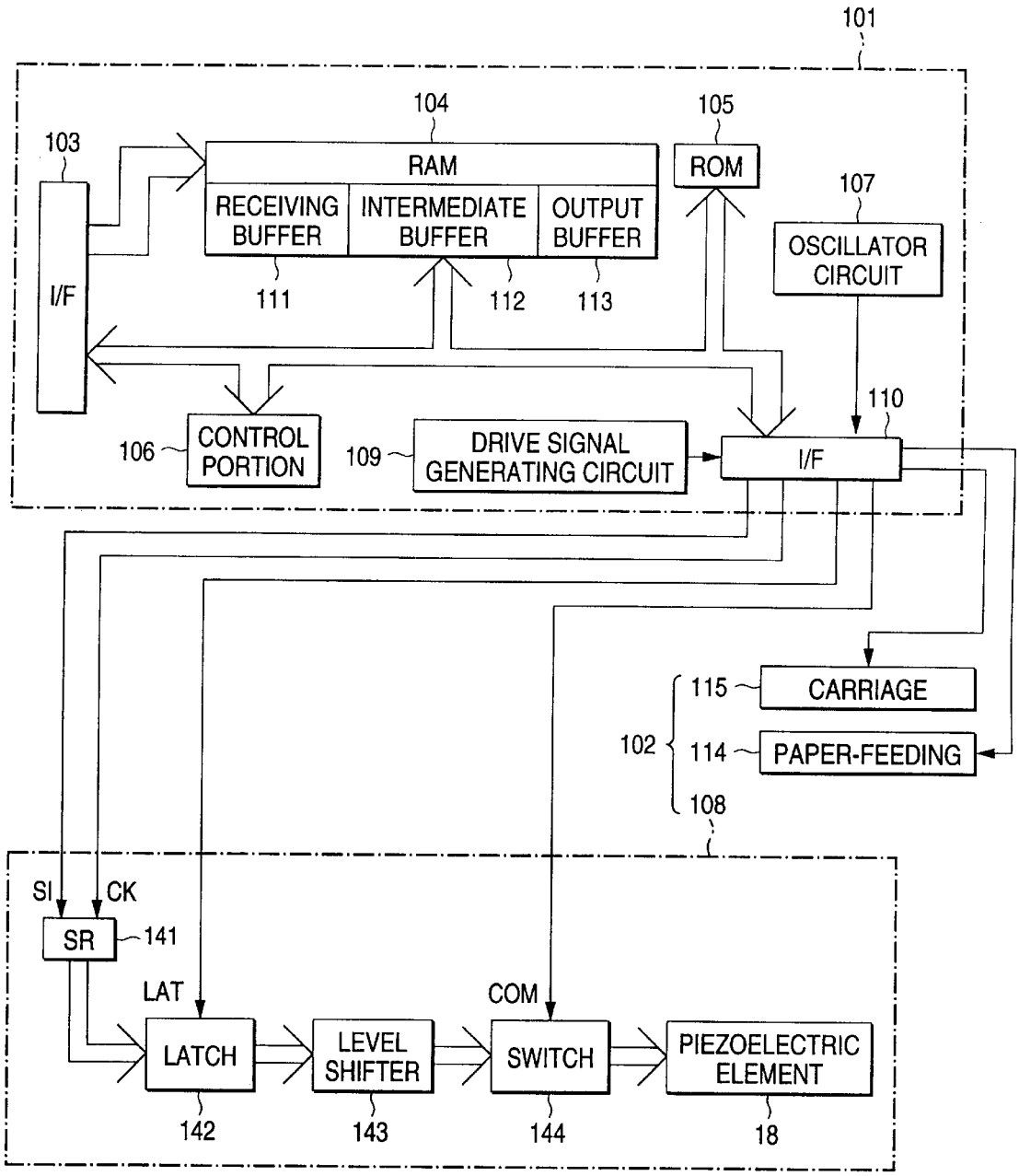
FIG. 1 is a block diagram showing an overall system of an ink jet printhead which is an embodiment 1 of the present invention.

FIG. 1 is a block diagram showing an overall system of an ink jet printhead which is constructed according to the present invention. As shown, the printhead is made up of a print controller 101 and a print engine 102.

The print controller 101 includes an external interface (external I/F) 103, a RAM 104 for temporarily storing various data, a ROM 105 for storing for example, control programs, a control portion 106 including mainly a CPU, an oscillator circuit 107 for generating a clock signal, a drive signal generating circuit 109 for generating a drive signal for transmission to an ink jet printhead 108, and an internal interface (referred to as an internal I/F) 110 for transmitting dot pattern data (bit map data), which is based on the drive signal and print data, to the print engine 102.

The external I/F 103 receives print data consisting of character codes, graphic functions, image data and others from a host computer (not shown). The print controller outputs a busy signal, an acknowledge signal and others to the host computer, for example, by way the external I/F 103.

The RAM 104 serves as a receiving buffer 111, an intermediate buffer 112, an outer buffer 113, and a work memory (not shown). The receiving buffer 111 temporarily stores print data received through the external I/F 103; the intermediate buffer 112 stores intermediate code data that is converted by the control portion 106; and the output buffer 113 stores dot pattern. The dot pattern data consists of print data that results from decoding (translating) tone data. The print data is represented by a 4-bit signal as will subsequently be described.

The ROM 105 stores at least font data and graphic data, in addition to control programs (control routines) for processing various data.

The control portion 106 reads out print data from the receiving buffer 111, and loads intermediate code data, which results from the conversion of the readout print data, into the intermediate buffer 112. The control portion analyzes the intermediate code data read out of the intermediate buffer 112, and develops the intermediate code data into dot pattern data while referring to the font data, graphic data and others that are stored in the ROM 105. The control portion 106 executes necessary modifying processes on the developed dot pattern data, and then stores the resultant into the output buffer 113.

When the print controller has acquired dot pattern data corresponding in amount to one line of the ink jet printhead 108, the dot pattern data of one line is output to the ink jet printhead 108 through the internal I/F 110. When the data pattern data of one line is output from the output buffer 113, the intermediate code data already developed is deleted from the intermediate buffer 112, and the control portion develops the next intermediate code data.

The print engine 102 includes the ink jet printhead 108, a paper feeding mechanism 114, and a carriage mechanism 115.

The paper feeding mechanism 114 includes at least a paper feeding motor and paper feeding rollers. The paper feeding mechanism successively feeds printing media, e.g., printing papers, to an appropriate location in synchronism with a printing operation of the ink jet printhead 108. The paper feeding mechanism 114 relatively moves a printing medium in the vertical scan direction.

The carriage mechanism 115 includes a carriage capable of carrying the ink jet printhead 108 thereon and a carriage drive unit for driving and moving the carriage in the main or horizontal scan direction. The carriage drive unit may take any form of mechanism if it is capable of moving the carriage. An example of a carriage drive mechanism using a timing belt may be presented.

The ink jet printhead 108 includes a number of nozzle orifices arrayed in the vertical scan direction, and ejects ink drops at the timings determined by dot pattern data, for example.

Figure 3:
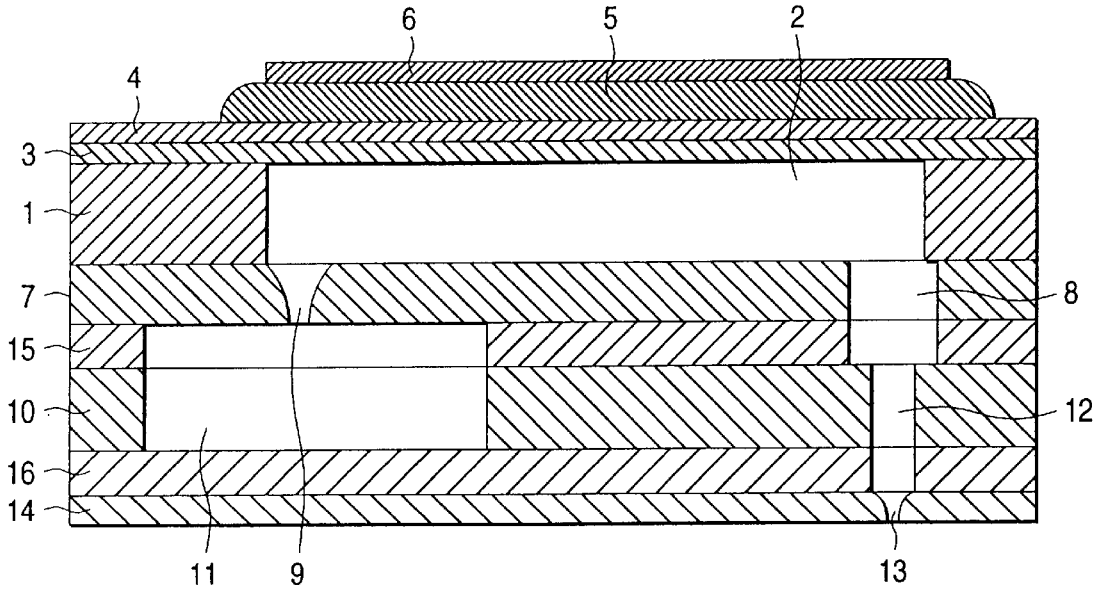
FIG. 3 is a cross sectional view showing the ink jet printhead of the embodiment 1.

Description of the details of the ink jet printhead 108 will given hereunder. A mechanical arrangement of the ink jet printhead 108 will be described with reference to FIG. 3 showing its key portion.

A spacer 1, which serves as a substrate for forming a pressure generating chamber is a ceramic plate made of zirconia ($ZrO_2$), about 50 $\mu$m thick. Through-holes to be used for pressure generating chambers 2 are formed in the spacer.

One of the broad surfaces of the spacer 1 is sealingly covered with an elastic plate 3 formed with a zirconia thin plate of 10 $\mu$m thick. A lower electrode 4 is formed over the surface of the elastic plate 3. Piezoelectric layers 5 are fastened onto the lower electrode 4. Piezoelectric layers 5 are provided in associated with the pressure generating chambers 2, respectively. The piezoelectric layers 5 are formed by sticking green sheets made of piezoelectric material onto the lower electrodes, sputtering piezoelectric material thereonto, or another proper manner. Upper electrodes 6 are formed on the surfaces of the piezoelectric layers 5, respectively. When voltage is applied, in accordance with print data, to between the lower electrode 4 and the upper electrode 6, which is layered on the piezoelectric layer associated with each pressure generating chamber 2, the piezoelectric layer 5 is flexurally deformed, together with the elastic plate 3.

The other broad surface of the spacer 1 is sealingly covered with an ink-supplying-port forming substrate 7 formed with a zirconia thin plate of 150 $\mu$m. Nozzle communicating holes 8 and ink supplying ports 9 are formed in the ink-supplying-port forming substrate 7. The nozzle communicating holes 8 communicatively interconnect orifices in a nozzle plate 14 and the pressure generating chambers 2, respectively. The ink supplying ports 9 communicatively interconnect reservoirs 11 to be described later and the pressure generating chambers 2, respectively.

A reservoir forming plate 10 may be an anti-corrosion plate member of stainless, 150 $\mu$m thick, suitable for forming ink passages therein. The reservoirs 11 and nozzle communicating holes 12 communicating with orifices 13 to be described later are formed in the reservoir forming plate 10. The side of the reservoir forming plate 10, opposite to a region including the spacer 1, is sealingly covered with the nozzle plate 14 with the orifices 13 formed therein. The orifices 13 of the nozzle plate are arrayed at the same pitches as the pressure generating chambers 2.

The ceramic members are layered into a unitary form, and sintered. The reservoir forming plate 10 and the nozzle plate 14 are firmly connected together with adhesive layers 15 and 16. The reservoir forming plate 10 and the nozzle plate 14 may also be made of ceramic material and formed into a unitary form.

In the ink jet printhead 108 thus constructed, the pressure generating chambers 2, respectively, confront piezoelectric elements 18 each operating in a flexural vibration mode. Electrical signals, such as a drive signal (com) and print data signals (which will be described later), are supplied to the piezoelectric elements 18 by way of a flexible cable (not shown).

In the ink jet printhead 108, when charged, the piezoelectric element 18 is downwardly curved and the pressure generating chamber 2 associated therewith contracts. With the contraction, an ink pressure increases within the pressure generating chamber 2. When discharged, the piezoelectric element 18 is released from its flexural deformation and the contracted pressure generating chamber 2 expands. With the expansion of the pressure generating chamber, ink flows from its related reservoir 11 into the related pressure generating chamber 2 by way of the related ink supplying port 9. Thus, the volume of the pressure generating chamber 2 is varied by charging and discharging the piezoelectric element 18. Therefore, an ink drop of desired size may be ejected from a desired orifice 13 by controlling the charging and discharging operations to and from the piezoelectric elements 18.

Next, an electrical arrangement of the ink jet printhead 108 will be described.

Figure 2:
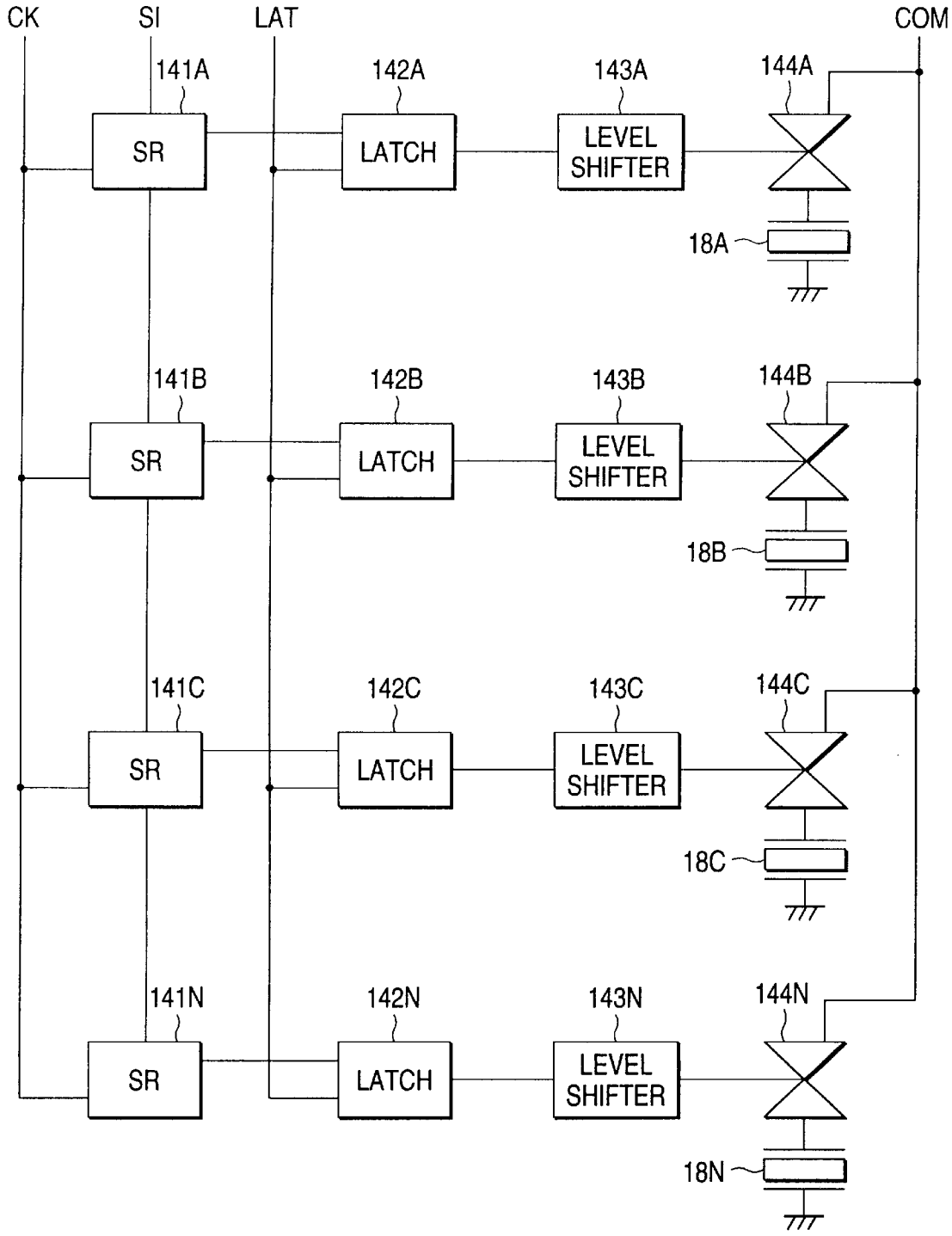
FIG. 2 is a block diagram showing a circuit arrangement of the ink jet printhead of the embodiment 1.

As shown in FIG. 1, the ink jet printhead 108 includes at least a shift register 141, a latch circuit 142, a level shifter 143, a switch 144, and a piezoelectric element 18. As shown in FIG. 2, the shift register 141, the latch circuit 142, the level shifter 143, the switch 144 and the piezoelectric element 18, respectively, consist of shift register elements 141A to 141N, latch elements 142A to 142N, level shift elements 143A to 143N, switch elements 144A to 144N, and piezoelectric elements 18A to 18N. The shift register 141, the latch circuit 142, the level shifter 143, the switch 144 and the piezoelectric element 18 are electrically connected in this order.

The shift register 141, the latch circuit 142, the level shifter 143 and the switch 144 cooperate to generate a drive pulse signal, in response to a drive signal produced by the drive signal generating circuit 109. Here, the "drive pulse signal" is a pulse signal actually applied to the piezoelectric element 18. The "drive signal" consists of a series of pulses (original drive pulse signal) defined by an original waveform, which are necessary for generating the drive pulse signal. The switch 144 functions also as switching means.

In the electrical arrangement of the ink jet printhead 108, print data SI forming dot pattern data is serially transferred from the output buffer 113 to the shift register 141 in synchronism with a clock signal CK that is output from the oscillator circuit 107, and successively set in the shift register. The most significant bits (MSBs) of the print data on the entire orifices 13 are serially transferred to the shift register. When the transfer of the MSBs is completed, then the second bits counted from the MSBs are transferred to the same, and so on.

In this way, those bits of the printed data on all the nozzles have been transferred and set in the shift register elements 141A to 141N. Following this, the control portion 106 outputs a latch signal LAT for transfer to the latch circuit 142 at a given time. The latch signal causes the latch circuit 142 to latch therein the print data from the shift register 141. The print data LAT out output from the latch circuit 142 is output to the level shifter 143 taking the form of a voltage amplifier. If the incoming print data is, for example, "1", the level shifter 143 pulls up the print data to a voltage value e.g., several tens of volts (V), high enough to drive the switch 144. The print data increased in its voltage is then applied to the switch elements 144A to 144N, and causes those elements to turn on.

The switch elements 144A to 144N have also received a basic drive signal COM from the drive signal generating circuit 109. When those switch elements are placed in an ON state, a drive signal COMout is applied to the piezoelectric elements 18A to 18N coupled for reception with the switch elements 144A to 144N.

Thus, the ink jet printhead 108 permits a drive signal to go to or inhibits it from going to the piezoelectric element 18 in accordance with the print data. During a period where the print data is "1", the switch 144 is placed to an ON state by a latch signal LAT. In this state, the printhead permits a drive signal COMout to go to the piezoelectric element 18. The drive signal COMout flexurally deforms the piezoelectric element 18. During a period where the print data is "0", the switch 144 is placed to an OFF state, and the printhead inhibits the drive signal COMout from going to the piezoelectric element 18. During this period of the print data of "0", the piezoelectric element 18 holds the preceding charge, and hence the piezoelectric element maintains its preceding displacement.

Figure 4:
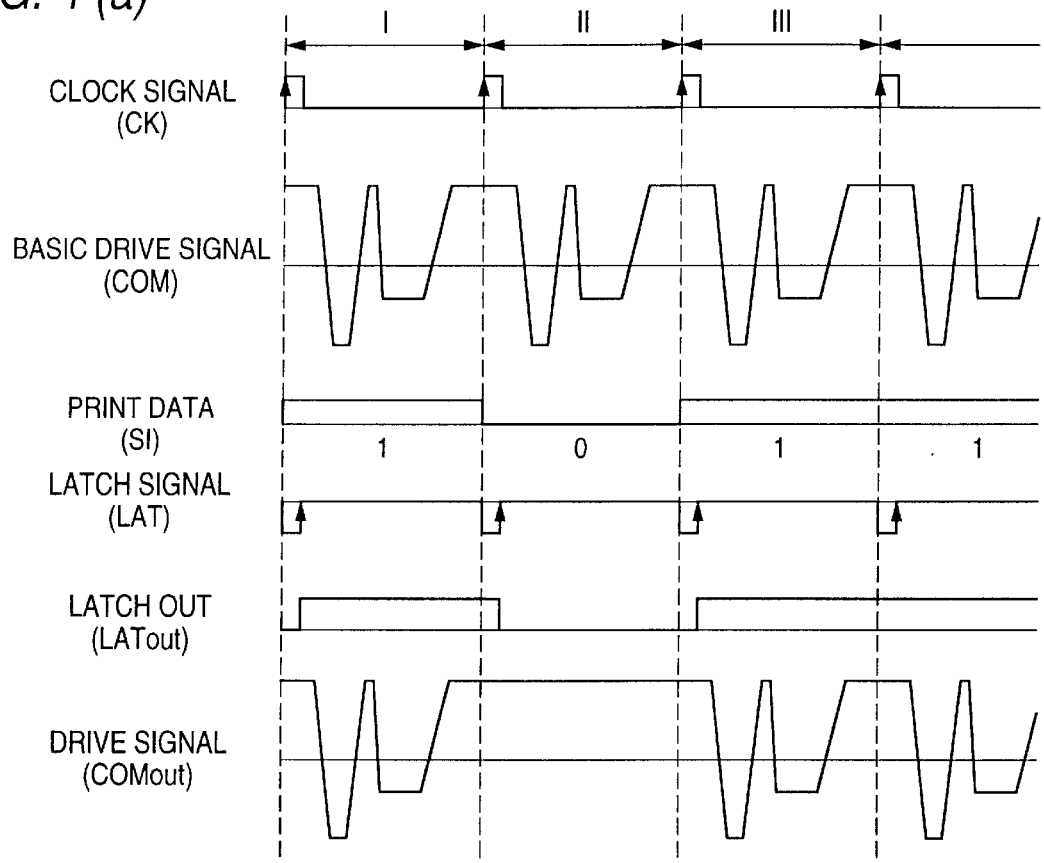
FIG. 4 is a waveform diagram showing a set of waveforms of signals at key portions in the ink jet printhead, and a waveform of a drive signal used in the printhead.
Figure 4:
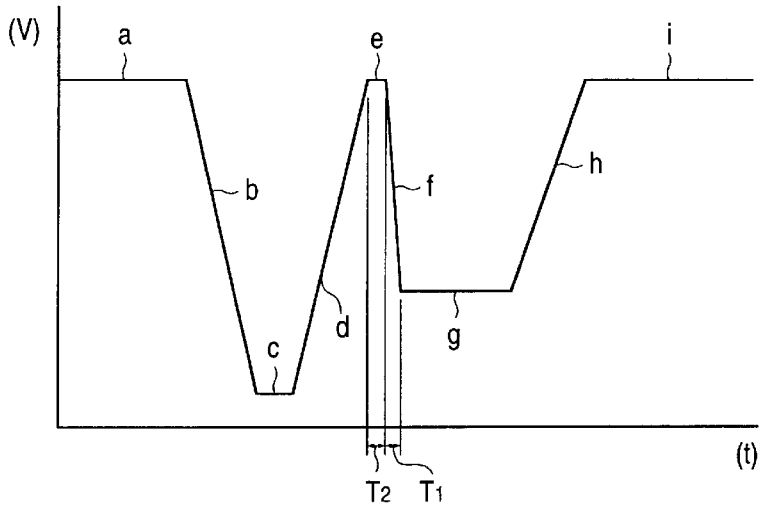

A waveform of the drive signal COMout is typically illustrated in FIG. 4B. This waveform of the drive signal is suitable for causing the printhead to eject a less volume of an ink drop. As shown in FIG. 4, the waveform of the drive signal includes a first hold region a for holding the most contracted state of the pressure generating chamber 2. In this region, the voltage between the lower electrode 4 and the upper electrodes 6 is kept at the highest voltage VH, for example, approximately 30 V. In a preparatory expansion region b, which follows the first hold region a, the meniscus surface is maximumly moved to the pressure generating chamber 2 within the nozzle orifice 13. To this end, the voltage applied to between the upper and lower electrodes is decreased to the lowest voltage VL or therearound. A second hold region c, which follows the preparatory expansion region b, times the ejection of an ink drop while holding the lowest voltage state. A first contraction region d follows the second hold region c. In this region d, to eject an ink drop, the voltage of the drive signal COMout is increased again to the highest voltage VH to contract the pressure generating chamber 2.

A third hold region e of which the width is extremely short or approximately 0, follows the first contraction region d, and is followed by a first expansion region f. The first expansion region f starts from a time point where middle of the meniscus surface level rises and formation of the leading part of an ink drop starts. In the first expansion region f, the outer peripheral edge of part 201*b* of the ink within the nozzle orifice, which is about to discharge as the result of the process by the first contraction region d, is pulled to the pressure generating chamber, while only the central part 201*a* of the ink is ejected out of the orifice in the form of an ink drop being smaller in diameter than the nozzle orifice (FIG. 5). A transient process of the ink drop ejection is as shown in FIGS. 5A1 to 5A3.

This phenomenon is caused when the ink meniscus vibrates in a higher order mode in the first expansion region f where the voltage variation is steep. The vibration mode of the meniscus is a called third order vibration mode in which the ejection velocity of the central part 201*a* little varies while the ejecting velocity of the outer peripheral edge of the ink greatly varies in the opposite direction to the ink ejection direction.

The timing of applying the drive signal for forming the first expansion region f is determined by a time duration of the third hold region e. In the first contraction region d, ink 202 being about to discharge from the orifice 13 begins to form a meniscus; its leading edge appears (FIG. 5A1); and the ink 202 is elongated in shape from the meniscus (FIG. 5B). It is preferable to apply the drive signal to the piezoelectric element during a time period from the ink elongation state (FIG. 5B) till an average velocity of ink ejection reaches zero (0) at a position 202*a* near to the orifice surface. If so done, the ejected ink drop is reduced in size.

To eject an ink drop of a small volume, it is preferable that the first expansion region f is timed so as to reduce the volume of an ink drop to be ejected, and an expansion period T1 of the first expansion region f is no more than ¼ Tc, wherein Tc is the Helmholtz frequency.

Further, it is preferable that the time period T2 of the third hold region e is selected to be ½ of the period Tc of the Helmholtz frequency. Specifically, the time period of the third hold region e is preferably no more than 3 microseconds, more preferably no more than 1 microsecond, viz., approximately 0. If so selected, a small ink drop can be ejected stably.

Figure 6:
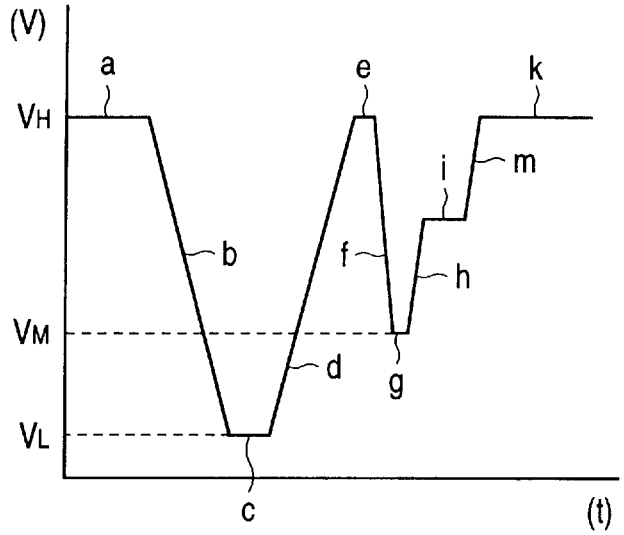
FIG. 6 shows another drive signal waveform adaptable for the embodiment 1.

Thus, the condition for ejecting the ink drop of a small volume depends on the contracting rate and the contraction-variation quantity in the first contraction region d and the expanding rate and the expansion-variation quantity in the first expansion region f. In this case, it is preferable that the expanding rate in the first expansion region f is larger than the contracting rate in the first contraction region d, and that the expansion-variation quantity in the first expansion region f is equal to or smaller than the contraction-variation quantity in the first contraction region d. Following to the first expansion region f, there are a fourth hold region g and a second contraction region h wherein the voltage changes from the intermediate voltage to the maximum voltage of which variation quantity is smaller than that of the first contraction region d. With provision of the fourth hold region g and the second contraction region h, damping of a great vibration of the meniscus after the ink drop ejection is adjusted. Another meniscus vibration damping process is shown in FIG. 6. As shown, a hold region 1, a second contraction region h and a third contraction region m may be provided subsequent to the fourth hold region g. The vibration damping process is not always required.

As described above, the drive signal having the thus configured waveform causes the printhead to eject an ink drop of an extremely small volume, and the ink drop volume is determined by the timing of setting up the first expansion region f and an expansion-variation quantity of the same region.

While at the drive signal waveform described above is trapezoidal in the above-embodiment, it may be rectangular. The waveform of the drive signal shown in FIG. 4B, even if the first expansion region f is removed therefrom, can produce a relatively small ink drop volume. It is evident that the drive signal may take any other suitable waveform.

Embodiment 2

Figure 7:
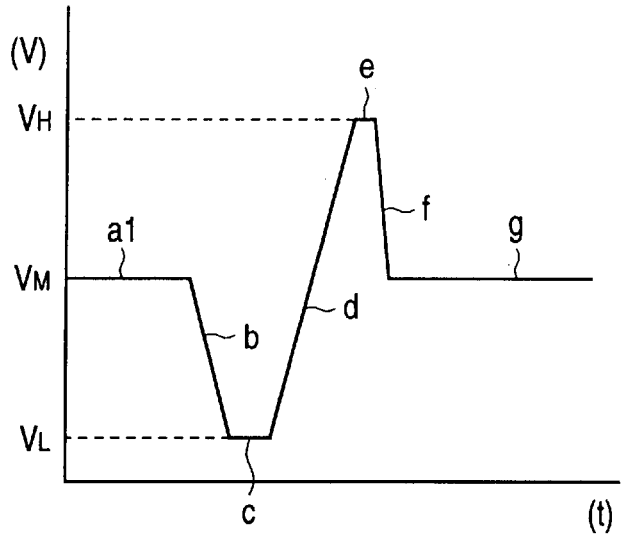
FIG. 7 shows a drive signal waveform forming an embodiment 2.

FIG. 7 shows another waveform of a drive signal which constitutes an embodiment 2 of the present invention.

Figure 8:
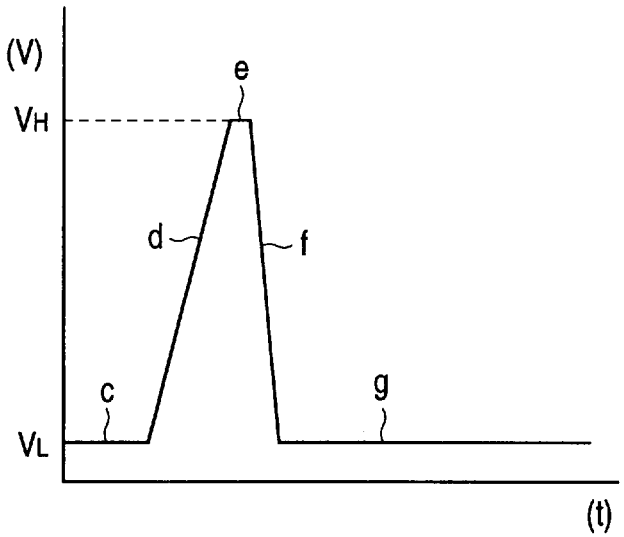
FIG. 8 shows another drive signal waveform forming an embodiment 2.

A waveform of the drive signal, which is configured according to the embodiment 2 of the invention, produces a relatively large drop volume, when comparing with the drive signal waveform (FIG. 4B) of the embodiment 1. A volume of the pressure generating chamber 2 when it is contracted in a first hold region a1 is smaller than that of the FIG. 4B case. Accordingly, a quantity of a movement of the meniscus surface within the nozzle orifice 13 when it is pulled to the pressure generating chamber 2 in a preparatory expansion region b1 is smaller than that of the FIG. 4B case, and a volume of an ink drop ejected in the first contraction region d is relatively larger than that in the FIG. 4B case. FIG. 8 shows another drive signal waveform which is configured exclusive of the first hold region a and the preparatory expansion region b in FIG. 4B. The FIG. 8 waveform produces a large ink drop volume.

In either waveform, the first contraction region d is followed by the third hold region e and the first expansion region f. Where those waveforms are used, the printhead ejects a small ink drop volume at high speed than the printhead driven by a drive signal of which the waveform does not include the first expansion region f.

Embodiment 3

Figure 9:
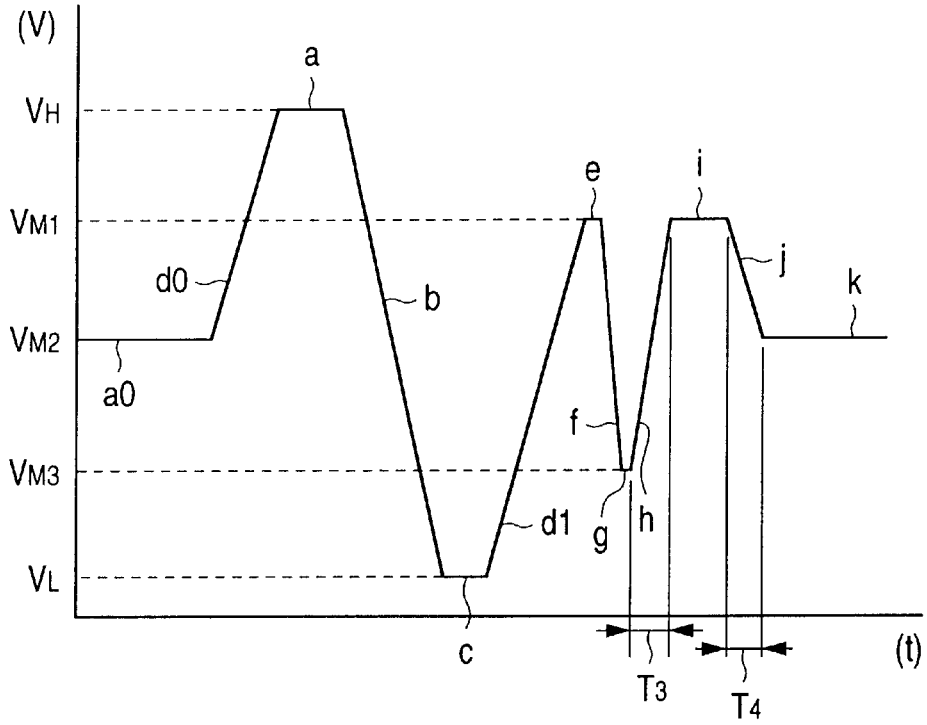
FIG. 9 shows a drive signal waveform forming an embodiment 3.

A drive signal waveform configured according to an embodiment 3 of the invention is shown in FIG. 9.

The FIG. 9 waveform of the drive signal is suitable for producing a smaller ink drop volume. In the drive signal waveform, a preparatory hold region a0 and a preparatory contraction region d0 are located preceding to the first hold region a. To be more specific, the drive signal waveform of the embodiment 3 includes the preparatory hold region a0 in which before the printhead is placed in a printing state, the voltage applied to between the lower electrode 4 and the upper electrodes 6 is gently increased from 0 V to a second intermediate voltage VM2, e.g., about 15 V, and holds its voltage state. Under this condition, the pressure generating chamber 2 takes a medium state, which is between the most contracted state and the most expanded state, and holds the medium state. The drive signal starts at the second intermediate voltage VM2, and as will be described later, during printing, its voltage is varied to a given voltage as required, and after the printing operation ends, the voltage of the drive signal is decreased from the second intermediate voltage VM2 to 0 V.

In the preparatory contraction region d0 of the drive signal waveform, the voltage applied to between the upper and lower electrodes is increased to the highest voltage VH, e.g., about 30 V. The first hold region a follows the preparatory contraction region d0. In this region a, the pressure generating chamber 2 holds the most contracted state.

The drive signal waveform includes a preparatory expansion region b. In this region, the voltage applied to between the electrodes is decreased to the lowest voltage VL, and the meniscus surface is maximumly pulled to the pressure generating chamber 2, within the nozzle orifice 13. A second hold region c and a first contraction region d1 follow the preparatory expansion region b. The second hold region o times the ejection of an ink drop while holding the lowest voltage state. In the first contraction region d1, to eject an ink drop, the drive signal voltage is increased to a first intermediate voltage VM1 to contract the pressure generating chamber 2. The first intermediate voltage VM1 is between a second intermediate voltage VM2 and the highest voltage VH.

As in the embodiment 1, third hold region e of which the width is extremely short or approximately 0, follows the first contraction region d1, and is followed by a first expansion region f. In the first expansion region f, the outer peripheral edge part 201*b* (FIG. 5) of the ink within the nozzle orifice, which is about to discharge as the result of the process by the first contraction region d1, is pulled to the pressure generating chamber, while only the central part 201*a* of the ink is ejected out of the orifice in the form of an ink drop being smaller in diameter than the nozzle orifice.

The condition for ejecting the ink drop of a small volume is as already stated. As recalled, the expansion-variation quantity in the first expansion region f is equal to or smaller than the contraction-variation quantity in the first contraction region d1. Therefore, in this embodiment, the voltage applied to between the electrodes, or the drive signal voltage, is decreased to a third intermediate voltage VM3 of about 5 V, for example, which is between the second intermediate voltage VM2 and the lowest voltage VL, whereby the pressure generating chamber 2 is expanded.

Further, the drive signal waveform of this embodiment includes a fourth hold region g and a second contraction region h, which follow the first expansion region f. The fourth hold region g has the width of substantially 0. A contraction-variation quantity in the second contraction region h is smaller than that in the first contraction region d1. With provision of those regions prevents a great pulling of the meniscus which follows the ink drop ejection, and damps a vibration of the meniscus occurring the meniscus pulling. It is preferable that a contraction period T3 of the second expansion region h is no more than ⅓ Tc, wherein Tc is the Helmholtz frequency of the pressure generating chamber 2. A time period from the start of the first contraction region d1 to the start of the second contraction region h is preferably shorter than the period Tc of the Helmholtz frequency of the pressure generating chamber, more preferably within a range from ¼ to ¾ of the period Tc.

The drive signal waveform further includes a fifth hold region i and a second expansion region j, which are subsequent to the second contraction region h. A combination of those regions i and j damp a great vibration of the meniscus surface occurring after the ink drop ejection. It is preferable that an expansion period T4 of the second expansion region j is no more than ½ Tc, wherein Tc is the Helmholtz frequency of the pressure generating chamber. A time period from the start of the first contraction region d1 to the start of the second expansion region j is preferably shorter than the period Tc of the Helmholtz frequency of the pressure generating chamber.

The drive signal waveform of the embodiment 4 produces a small ink drop volume, as of the embodiment 1. Further, it prevents a great pulling of the meniscus level to the pressure generating chamber after the ink drop ejection, and damps a vibration of the meniscus.

Embodiment 4

Figure 10:
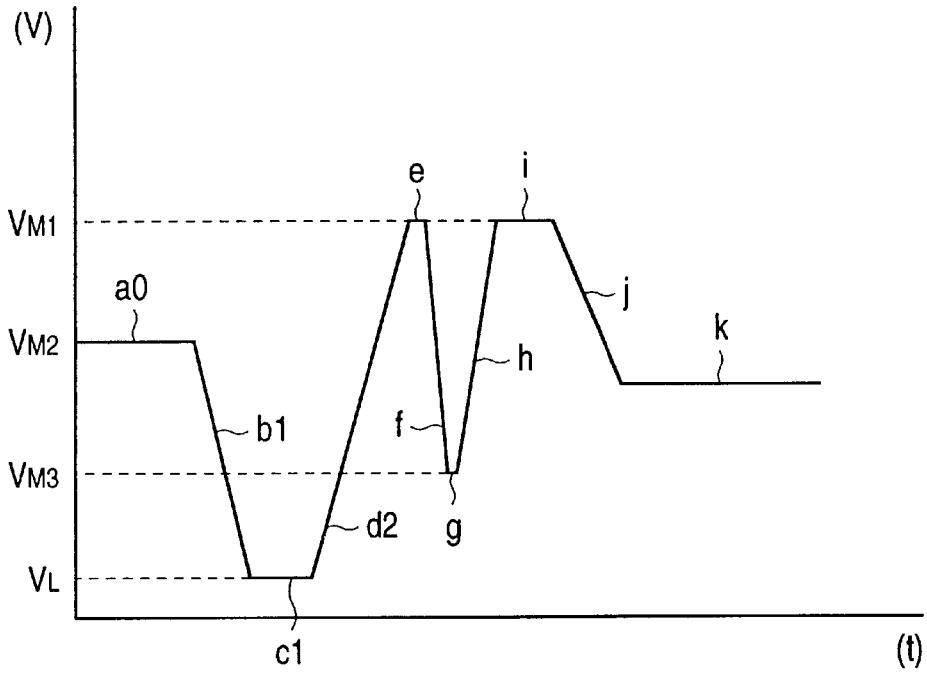
FIG. 10 shows a drive signal waveform forming an embodiment 4.

FIG. 10 shows a drive signal waveform configured according to an embodiment 4 of the present invention. This waveform produces a larger ink drop volume than that by the embodiment 3. In the waveform, the preparatory contraction region d0 following the preparatory hold region a0 and the first hold region a1 are removed, and the preparatory hold region a0 is subsequently continuous to a preparatory expansion region b1 for pulling the ink meniscus to the pressure generating chamber 2 in preparation for ink drop ejection. The quantity of the meniscus pulling in the preparatory expansion region b1 is smaller than in the embodiment 3, and after a second hold region c1, an ink drop is ejected by a first contraction region d2. The subsequent ink ejection process is similar to that in the embodiment 3. As shown, the first expansion region f is followed by a fourth hold region g of which the voltage holding time period is substantially 0 and a second contraction region h of which the contraction-variation quantity is smaller than that in the first contraction region d2.

The drive signal waveform of the embodiment 4 produces a relatively small ink drop volume, and damps a great meniscus vibration occurring after the ink drop ejection.

Embodiment 5

Figure 11:
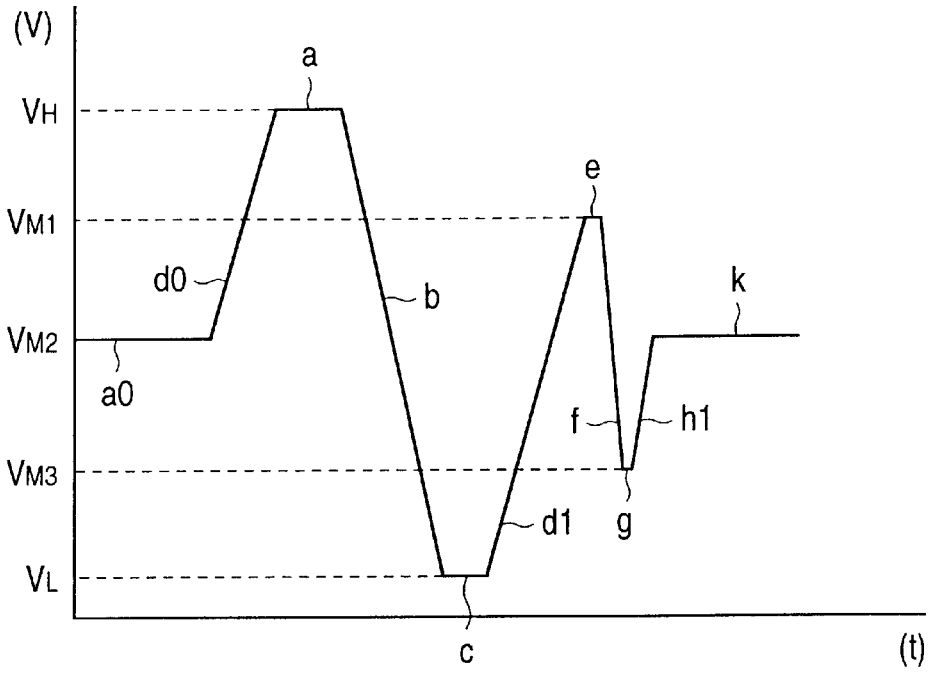
FIG. 11 shows a drive signal waveform forming an embodiment 5.

FIG. 11 shows a drive signal waveform configured according to an embodiment 5.

The waveform of this embodiment is the same as that of the embodiment 3 except that the fifth hold region i and the second expansion region j, which are subsequent to the second contraction region h, are omitted.

The ink jet printhead, which uses the drive signal waveform of the embodiment 5, ejects an ink drop of a relatively small drop-volume at high speed, and the waveform damps a great meniscus vibration occurring after the ink drop ejection. The number of waves contained in the drive signal waveform of the embodiment 5 is smaller than that in the embodiment 3, and a time period from the start of the waveform to the end thereof is shorter than of the embodiment 3. However, the waveform of this embodiment can sufficiently suppress the meniscus vibration where ink of low viscosity is used.

Embodiment 6

Figure 12:
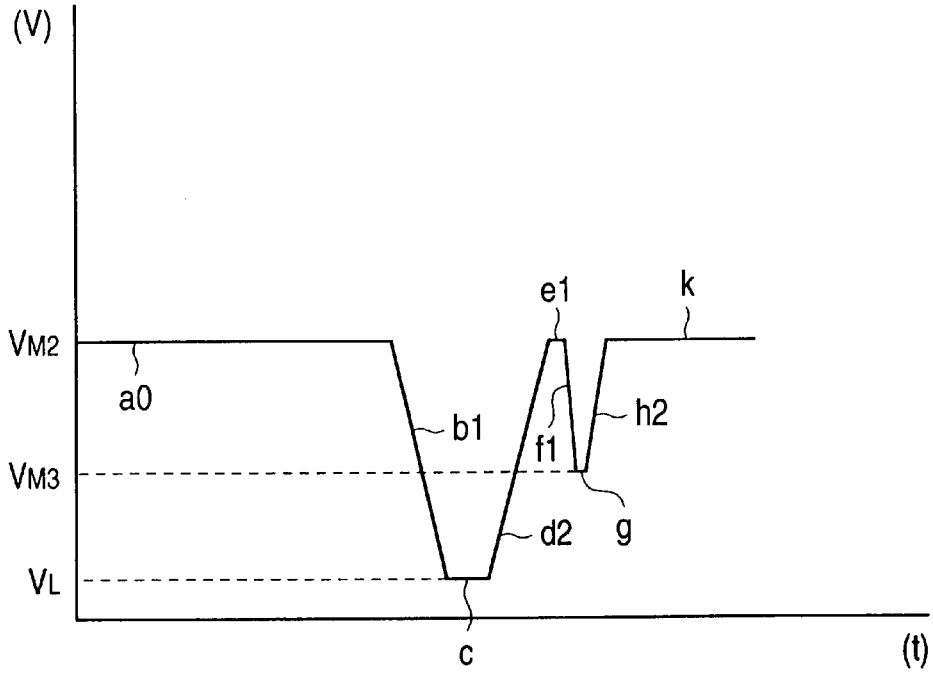
FIG. 12 shows a drive signal waveform forming an embodiment 6.

FIG. 12 shows a drive signal waveform configured according to an embodiment 6.

The waveform of this embodiment is different from the embodiment 3 in that the preparatory contraction region d0, the first hold region a, the fifth hold region i and the second expansion region j, which follow the second contraction region h (=h2 in this embodiment), are omitted. Further, it is different from the embodiment in that the drive signal voltage applied to the upper and lower electrodes in the third hold region e1 is lowered. With this, a contraction quantity of the pressure generating chamber 2 in the first contraction region d2 is smaller than that in the embodiment 3.

In this embodiment, the maximum drive voltage is set at the second intermediate voltage VM2. Because of this, there is no need for increasing the drive signal voltage up to the highest voltage VH.

Embodiment 7

Figure 13:
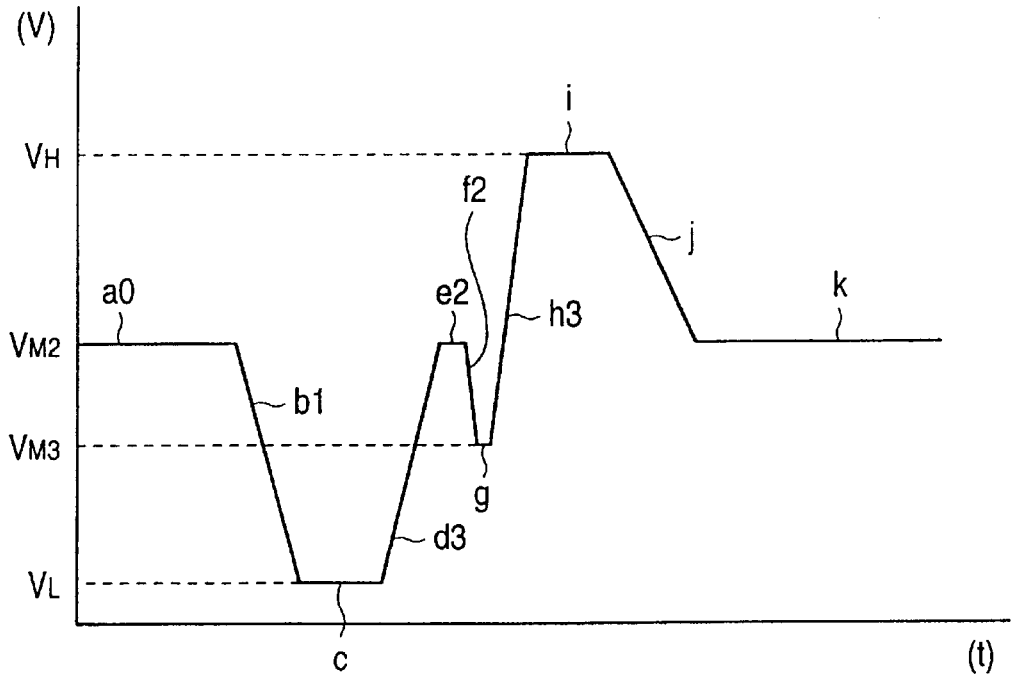
FIG. 13 shows a drive signal waveform forming an embodiment 7.

FIG. 13 shows a drive signal waveform configured according to an embodiment 7.

The drive signal waveform of this embodiment is different from that of the embodiment 3 in that the preparatory contraction region d0 and the first hold region a are omitted. Further, it is different from the embodiment 3 in that the drive signal voltage, which is applied to between the upper and lower electrodes in a third hold region e2 following a first contraction region d3, is lowered, so that a quantity of an expansion of the pressure generating chamber 2 caused in a first expansion region f2 is smaller than that in the embodiment 3.

The voltage held in the fifth hold region i following a second contraction region h3 is larger than held in the third hold region e2 following a first contraction region d3. Therefore, the embodiment 7 more effectively suppresses the meniscus vibration.

Embodiment 8

Figure 14:
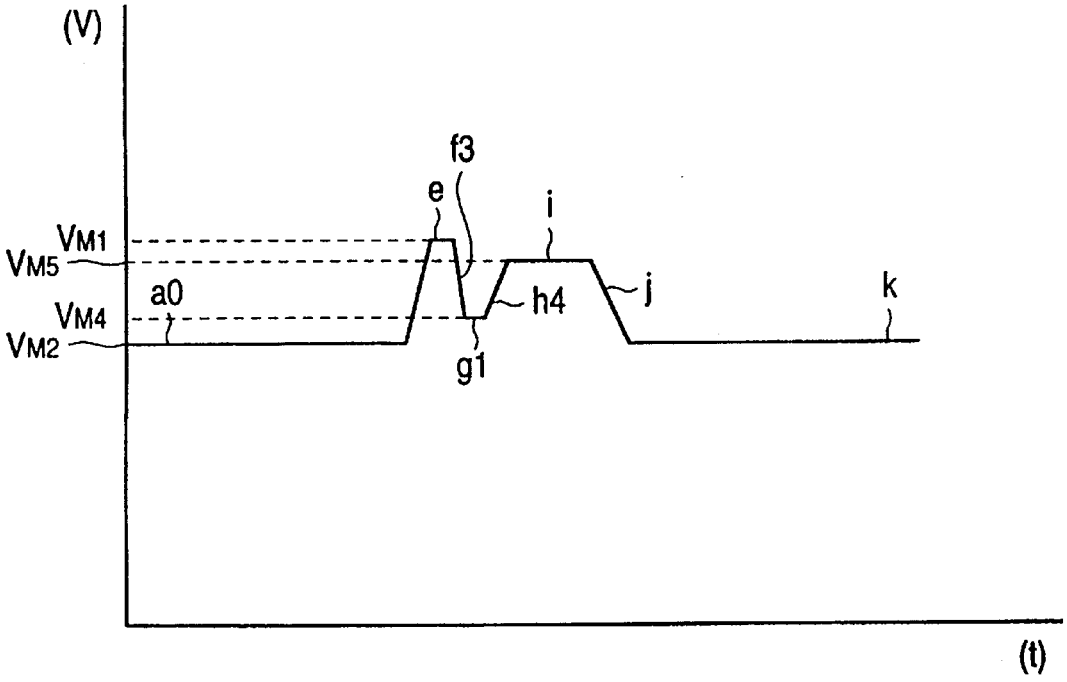
FIG. 14 shows a drive signal waveform forming an embodiment 8.

FIG. 14 shows a drive signal waveform configured according to an embodiment 8.

The drive signal waveform of this embodiment is different from the embodiment 3 in the following points. The preparatory contraction region d0, the first hold region a, the preparatory expansion region b, and the second hold region c are omitted. The drive voltage that is applied to between the electrodes in a fourth hold region g1 is increased to the fourth intermediate voltage VM4 from the second intermediate voltage VM2 which is smaller value than VM4. With this, a quantity of expansion of the pressure generating chamber 2 caused in a first expansion region f3 is smaller than in the embodiment 3.

This also changes the hold voltage of the fifth hold region i, which is subsequent to the second contraction region h4, the voltage higher than the fourth intermediate voltage VM4, but the voltage lower than the fifth intermediate voltage VM5.

In the embodiment 8, the minimum voltage is set at the second intermediate voltage VM2. Because of this, an ink drop volume is larger than in the above-mentioned embodiment, but satellite ink drops are advantageously small in size.

Other Embodiments

While some specific embodiments of the present invention have been described, any special limitation is not placed on the structure of an ink jet printhead to which the print head method of the invention may be applied. An example of the printhead structure that accepts the printhead drive method is such that a silicon substrate of piezoelectric actuators is used in place of the ceramic substrate, and the actuators are formed on the silicon substrate by thin film process, and the pressure generating chambers are formed by anisotropic etching process. Also for the positions and locations of the nozzle orifices and the reservoirs, any special limitation is not placed on the ink supply structure. The printhead drive method of the invention is applicable to ink jet printheads using the piezoelectric actuators of the torsional vibration type and the longitudinal vibration type, as matter of course.

Figure 15:
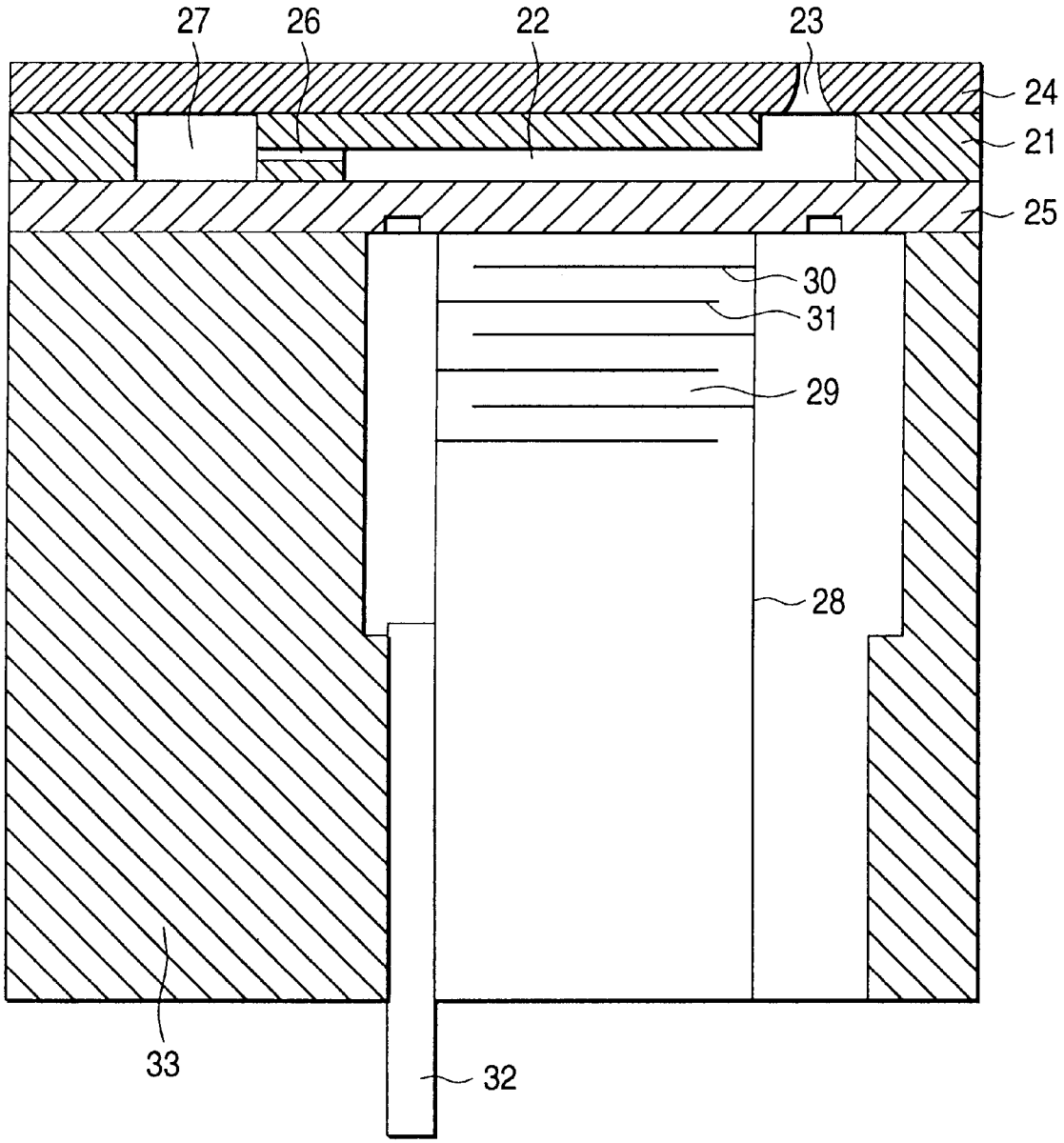
FIG. 15 is a cross sectional view showing the ink jet printhead of another embodiment.

FIG. 15 is a cross sectional view showing an ink jet printhead using a piezoelectric actuator of the longitudinal vibration type. As shown, a pressure generating chamber 22 is formed in a spacer 21. The broad sides of the spacer 21 are sealingly covered with a nozzle plate 24 having nozzle orifices 23 and an elastic plate 25, respectively. A reservoir 27 is formed in the spacer 21. The reservoir 27 communicates with the pressure generating chamber 22, through an ink supply pot 26. The reservoir 27 is communicatively connected to the reservoir 27.

The top end of a piezoelectric element 28 is abutted against the opposite side of the elastic plate 25 to the pressure generating chamber 22. The piezoelectric element 28 has a multi-layered structure. In the structure, piezoelectric member 29 and sandwiched between electrode members 30 and 31 are alternately layered in a sandwiching manner. Their inactive regions not contributing to vibrations are fixedly mounted on a fixing plate 32. The fixing plate 32, the elastic plate 25, the spacer 21 and the nozzle plate 24 are coupled into a unitary form, with the aid of a base member 33.

In the thus constructed ink jet printhead, voltage is applied to between the electrode members 30 and 31 of the piezoelectric element 28. Then, the piezoelectric element 28 expands toward the nozzle plate 24, the electric plate 25 is displaced, and a volume of the pressure generating chamber 22 is reduced. With this structure, if the voltage is increased from 0 V to about 30 V, the piezoelectric element 28 is contracted, and ink is supplied from the reservoir 27 to the pressure generating chamber 22 by way of the ink supply pot 26. Thereafter, voltage is applied to the piezoelectric element. Then, the piezoelectric element 28 is expanded to cause the elastic plate 25 to contract the pressure generating chamber 22, and an ink drop is discharge through the nozzle orifices 23.

Therefore, it is seen that the printhead drive method of the invention may be applied to the thus structured ink jet printhead. In this case, the printhead can eject an ink drop of a relatively small volume without reducing the traveling velocity of the ink drop.

The illustrated and explained ink jet printhead is of the type in which the pressure generating chamber is contracted by applying voltage to the piezoelectric element. It is readily seen that the printhead drive method of the invention is applicable to an ink jet printhead of the type in which the pressure generating chamber is expanded by applying voltage to the piezoelectric element.

Figure 16:
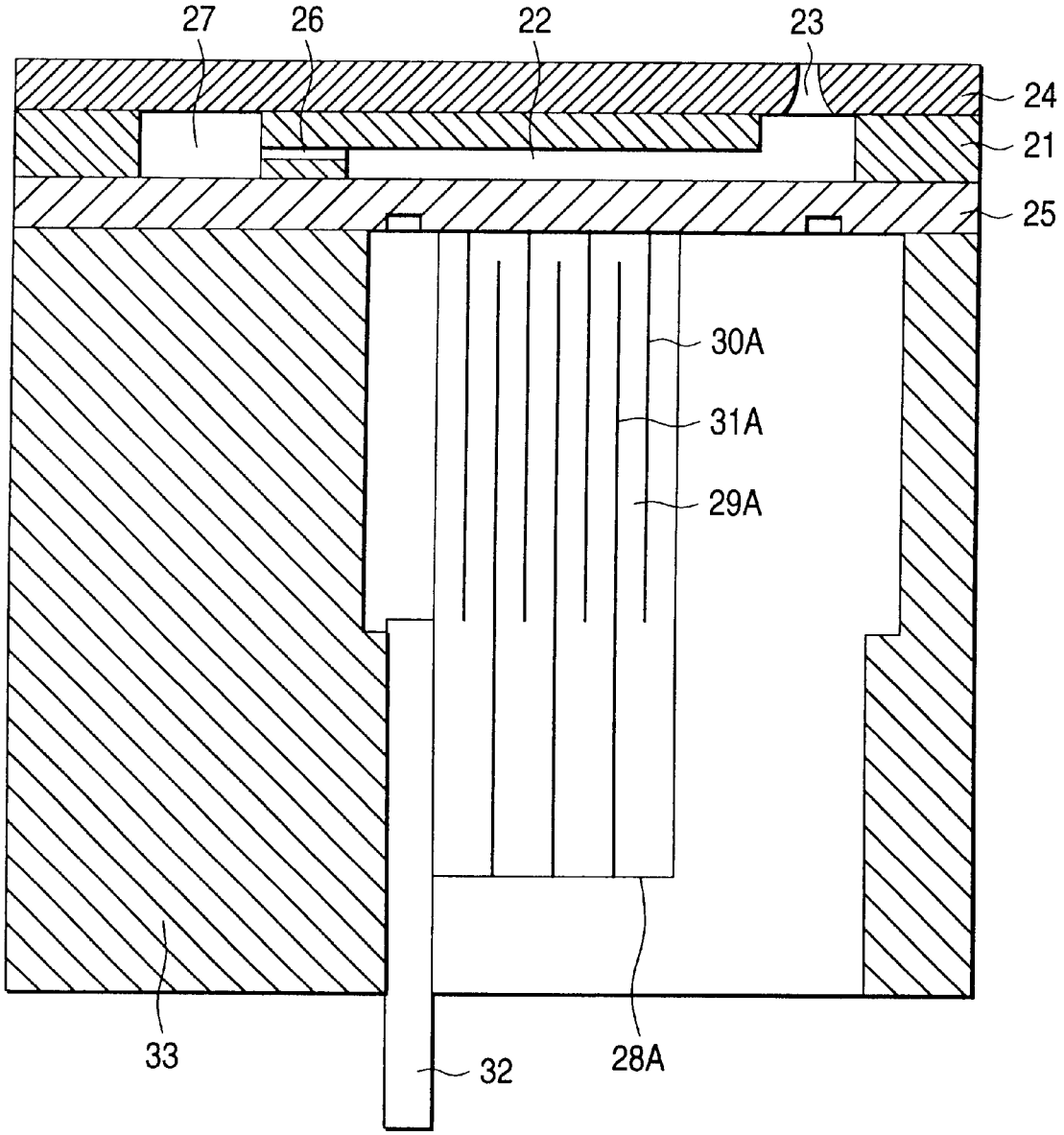
FIG. 16 is a cross sectional view showing the ink jet printhead of yet another embodiment.
Figure 17:
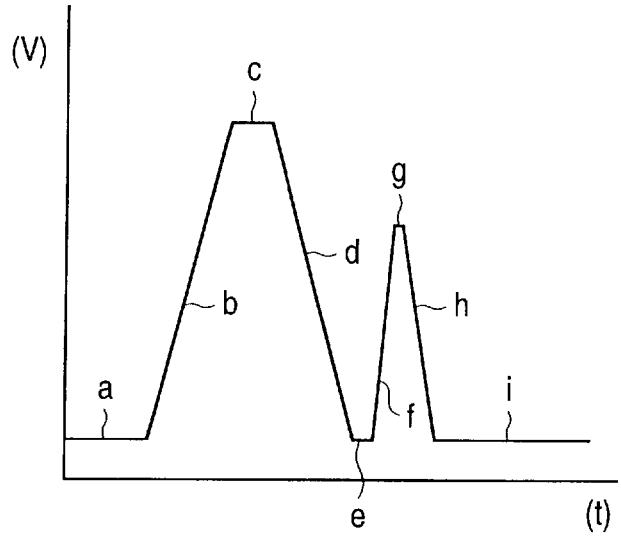
FIG. 17 shows a first drive signal waveform forming the FIG. 16 embodiment.
Figure 18:
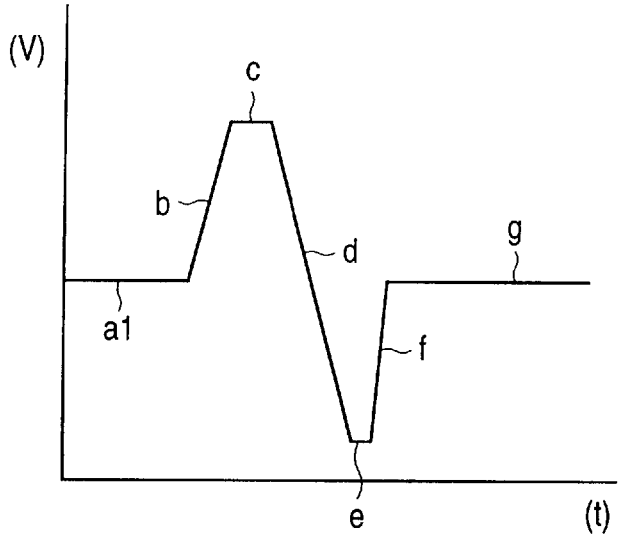
FIG. 18 shows a second drive signal waveform forming the FIG. 16 embodiment.
Figure 19:
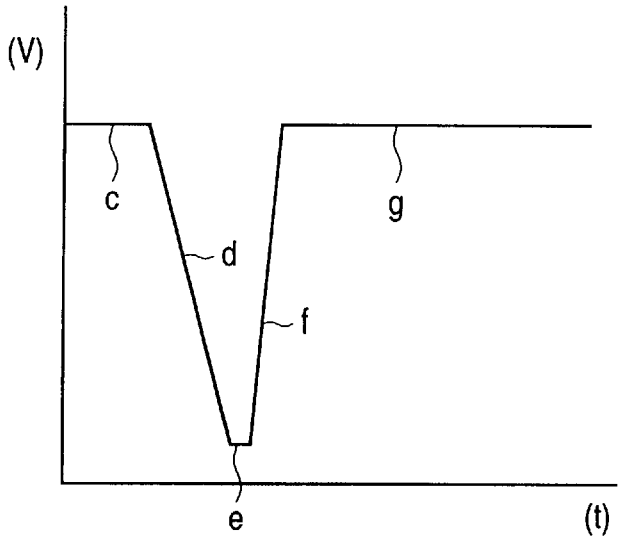
FIG. 19 shows a third drive signal waveform forming the FIG. 16 embodiment.
Figure 20:
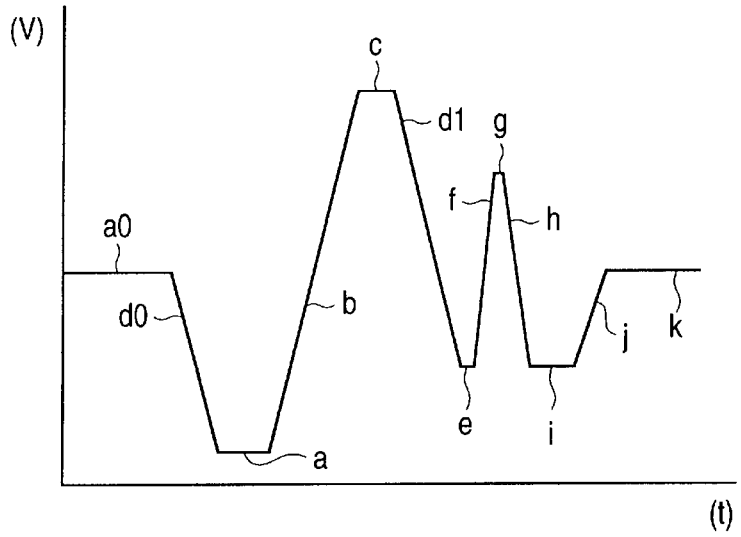
FIG. 20 shows a fourth drive signal waveform forming the FIG. 16 embodiment.
Figure 21:
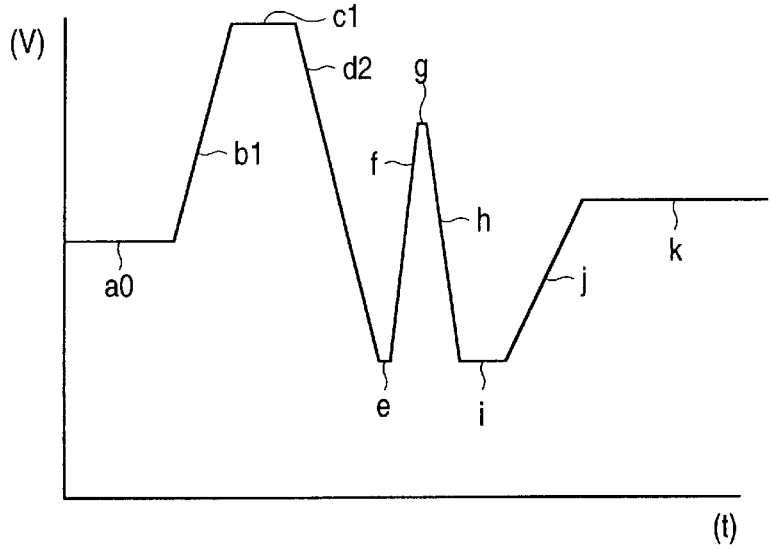
FIG. 21 shows a fifth drive signal waveform forming the FIG. 16 embodiment.
Figure 22:
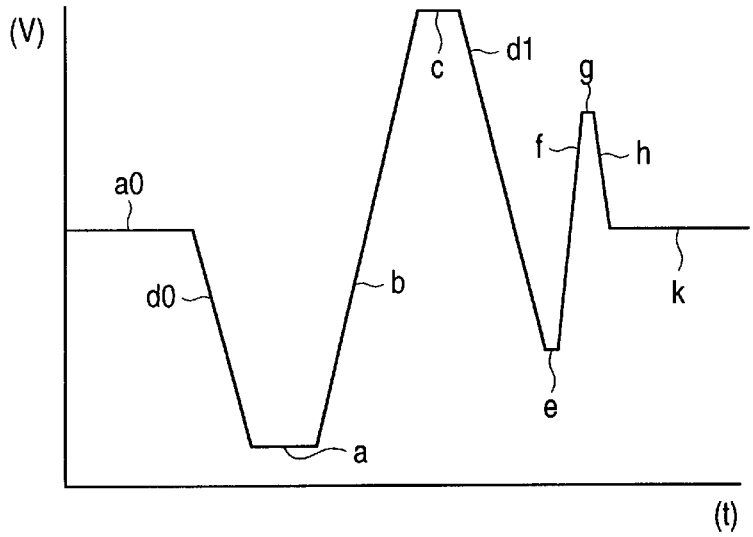
FIG. 22 shows a sixth drive signal waveform forming the FIG. 16 embodiment.
Figure 23:
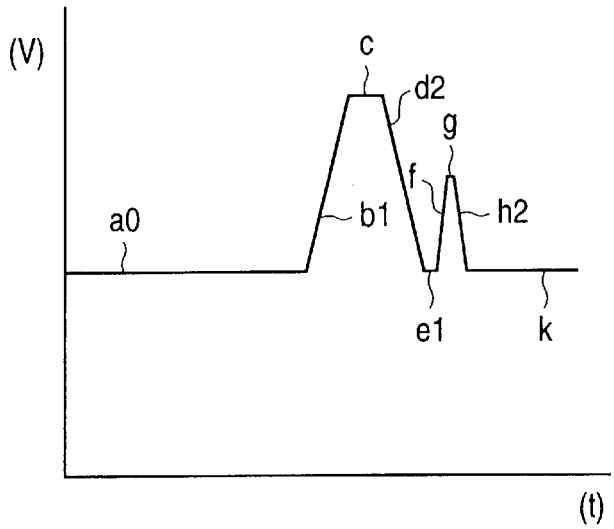
FIG. 23 shows a seventh drive signal waveform forming the FIG. 16 embodiment.
Figure 24:
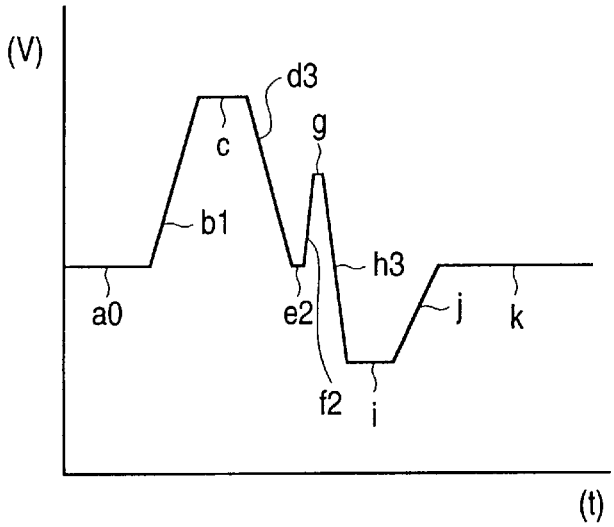
FIG. 24 shows an eighth drive signal waveform forming the FIG. 16 embodiment.
Figure 25:
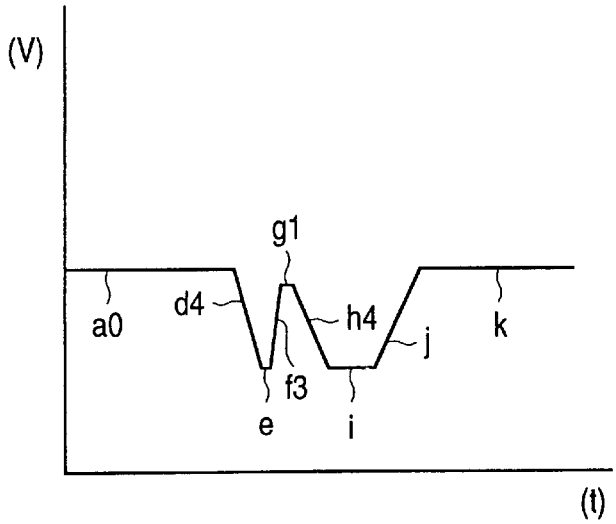
FIG. 25 shows a ninth drive signal waveform forming the FIG. 16 embodiment.

This type of ink jet printhead is typically shown in FIG. 16. The structure of this ink jet printhead is substantially the same as of the FIG. 15 printhead except that a piezoelectric element 29A is used in place of the piezoelectric element 28 in the FIG. 15 structure. In FIG. 16 structure, electrode members 30A and 31A are alternately layered such that each piezoelectric element 28 is interposed there between. In operation, voltage is applied to between the electrode members 30A and 31A; the piezoelectric element 28A contracts; the pressure generating chamber 22 expands; in this state, the voltage is removed; the pressure generating chamber 22 contracts; and an ink drop is ejected through the nozzle orifice 23. The printhead drive method of the invention is applicable to the ink jet printhead thus constructed. In this case, the voltage application step and the voltage removal step in the above-mentioned printhead drive method are reversed in the order of their execution.

FIGS. 17 to 25 show drive signal waveforms adaptable for the driving the thus constructed ink jet printhead. The waveforms illustrated in FIGS. 17 to 25 correspond to those in FIG. 4B, and FIGS. 7 to 14. Like reference numerals are applied to indicate like waveform regions, for simplicity. Differences from the already illustrated and described waveform regions are: voltage is applied in the preparatory contraction region d0 and the first expansion region f, and voltage is removed in the first contraction region d. The functions of those regions are substantially the same as those in the already-stated ones.

As seen from the foregoing description, a method of driving an ink jet printhead, constructed according to the present invention, includes: a first contracting step for ejecting an ink drop through a nozzle orifice by contracting a pressure generating chamber; and a first expanding step for expanding the pressure generating chamber till a velocity of the trailing end of the ejected ink drop is substantially 0 at a position near the nozzle orifice, whereby an expansion of the pressure generating chamber starts before the ejection of the ink drop, which started in response to the contraction of the pressure generating chamber caused in the first contraction step, is not completed, and as a result, only the portion of ink having been about to discharge is ejected in the form of an ink drop. Therefore, the printhead can form an ink dot suitable for graphic printing without decreasing a traveling velocity of the ink drop and with an amount of the ink drop being reduced to a minimum. Further, the printhead can readily produce an ink drop of a large volume.

The ink jet printhead may further include a second contracting step, following the first expanding step, for contracting the pressure generating chamber again. Use of the second contracting step suppresses vibrations of the ink meniscus occurring after the ink drop ejection in preparation for the next ink drop ejection. High speed and stable printing results.

What is claimed is:

1. A method of driving an ink jet printhead in which when one of piezoelectric vibrators each associated with a pressure generating chamber, being communicatively connected to a nozzle orifice and a reservoir, is driven so that said pressure generating chamber is expanded or contracted to eject an ink drop through said nozzle orifice, said method comprising:

a contracting step for ejecting an ink drop through said nozzle orifice by contracting said pressure generating chamber; and an expanding step for expanding said pressure generating chamber until a velocity of a trailing end of the ejected ink drop is substantially 0 at a position near said nozzle orifice.

2. The method of driving an ink jet printhead according to claim 1, in which an expansion of said pressure generating chamber in said expanding step following to said contracting step starts after a time point where the meniscus of ink in said nozzle orifice starts to be deformed to form the leading edge of an ink drop to be ejected through said nozzle orifice.

3. The method of driving an ink jet printhead according to claim 1 or 2, in which an expansion period of said expanding step is no more than ¼ Tc, wherein Tc is the Helmholtz frequency of said pressure generating chamber.

4. The method of driving an ink jet printhead according to claim 1, further comprising a hold step following to said contracting step, for holding the contraction state of said pressure generating chamber for a period of not more than ⅓ Tc, wherein Tc is the Helmholtz frequency of said pressure generating chamber.

5. The method of driving an ink jet printhead according to claim 1, further comprising a preparatory step, followed by said contraction step, for preparing the ejection of an ink drop by expanding said pressure generating chamber.

6. The method of driving an ink jet printhead according to claim 1, in which an expanding rate in said expanding step is larger than a contracting rate in said contracting step.

7. The method of driving an ink jet printhead according to claim 1, in which an expansion-variation quantity in said expanding step is smaller than a contraction-variation quantity in said contracting step.

8. A method of driving an ink jet printhead in which when one of piezoelectric vibrators each associated with a pressure generating chamber, being communicatively connected to a nozzle orifice and a reservoir, is driven so that said pressure generating chamber is expanded or contracted to eject an ink drop through said nozzle orifice, said method comprising:

a contracting step for ejecting an ink drop through said nozzle orifice by contracting said pressure generating chamber; and an expanding step for expanding said pressure generating chamber at such a timing as to reduce a volume of an ink drop to be ejected for a period of not more than ¼ Tc, wherein Tc is the Helmholtz frequency of said pressure generating chamber.

9. A method of driving an ink jet printhead in which when one of piezoelectric vibrators each associated with a pressure generating chamber, being communicatively connected to a nozzle orifice and a reservoir, is driven so that said pressure generating chamber is expanded or contracted to eject an ink drop through said nozzle orifice, said method comprising:

a contracting step for ejecting an ink drop through said nozzle orifice by contracting said pressure generating chamber; a hold step for holding the contraction state of said pressure generating chamber for a period of not more than ⅓ Tc, wherein Tc is the Helmholtz frequency of said pressure generating chamber; and an expanding step for expanding said pressure generating chamber for a period of not more than ¼ Tc.

10. The method of driving an ink jet printhead according to claim 4 or 9, in which said holding time period of said hold step is no more than 3 microseconds.

11. The method of driving an ink jet printhead according to claim 4 or 9, in which said holding time period of said hold step is no more than 1 microsecond.

12. A method of driving an ink jet printhead in which when one of piezoelectric vibrators each associated with a pressure generating chamber, being communicatively connected to a nozzle orifice and a reservoir, is driven so that said pressure generating chamber is expanded or contracted to eject an ink drop through said nozzle orifice, said method comprising:

a first contracting step for ejecting an ink drop through a nozzle orifice by contracting a pressure generating chamber; a first expanding step for expanding said pressure generating chamber till a velocity of the trailing end of the ejected ink drop is substantially 0 at a position near said nozzle orifice; and a second contracting step for contracting said pressure generating chamber so as to reduce a retraction of the ink meniscus occurring after said expanding step is executed.

13. A method of driving an ink jet printhead according to claim 12, in which an expansion of said pressure generating chamber is said first expanding step following to said first contracting step starts after a time point where the meniscus of ink in said nozzle orifice starts to be deformed to form the leading edge of an ink drop to be ejected through said nozzle orifice.

14. The method of driving an ink jet printhead according to claim 12 or 13, in which an expansion period of said first expanding step is no more than ¼ Tc, wherein Tc is the Helmholtz frequency of said pressure generating chamber.

15. The method of driving an ink jet printhead according to claim 12, further comprising a hold step, following to said contracting step, for holding the contraction state of said pressure generating chamber for a period of not more than ⅓ Tc, wherein Tc is the Helmholtz frequency of said pressure generating chamber.

16. The method of driving an ink jet printhead according to claim 12, further comprising a second expanding step, following to said first expanding step, for expanding said pressure generating chamber so as to suppress vibrations of the meniscus after the ink drop ejection.

17. The method of driving an ink jet printhead according to claim 12, further comprising a preparatory step, followed by said first contraction step, for preparing the ejection of an ink drop by expanding said pressure generating chamber.

18. The method of driving an ink jet printhead according to claim 12, in which said second contracting step starts during a time period ranging from a time point where the ink meniscus starts to retract after the leading edge of an ink drop departs from said nozzle orifice to a time point where the meniscus retracts to its full distance.

19. The method of driving an ink jet printhead according to claim 12, in which a time period ranging from the start of said first contracting step to the start of said second contracting step is no more than the period Tc of the Helmholtz frequency of said pressure generating chamber.

20. The method of driving an ink jet printhead according to claim 12, in which a time period ranging from the start of said first contracting step to the start of said second contracting step is within a range from ¼ Tc to ¾ Tc, wherein Tc is the Helmholtz frequency of said pressure generating chamber.

21. The method of driving an ink jet printhead according to claim 12, in with each of the contraction periods of said pressure generating chamber in said first and second contracting steps is no more than ½ Tc, wherein Tc is the Helmholtz frequency of said pressure generating chamber.

22. The method of driving an ink jet printhead according to claim 12, in which the contraction period of said pressure generating chamber in said second contracting step is no more than ⅓ Tc, wherein Tc is the Helmholtz frequency of said pressure generating chamber.

23. A method of driving an ink jet printhead in which when one of piezoelectric vibrators each associated with a pressure generating chamber, being communicatively connected to a nozzle orifice and a reservoir, is driven so that said pressure generating chamber is expanded or contracted to eject an ink drop through said nozzle orifice, said method comprising:

a contracting step for ejecting an ink drop through said nozzle orifice by contracting said pressure generating chamber; an expanding step for expanding said pressure generating chamber at such a timing as to reduce a volume of an ink drop to be ejected for a period of not more than ¼ Tc, wherein Tc is the Helmholtz frequency of said pressure generating chamber; and a second contracting step for contracting said pressure generating chamber so as to reduce a retraction of the ink meniscus occurring after said expanding step is executed.

24. The method of driving an ink jet printhead according to claim 23, in which a time period ranging from the start of said first contracting step to the start of said second expanding step is no more than Tc of the Helmholtz frequency of said pressure generating chamber.

25. The method of driving an ink jet printhead according to claim 23, in which the expansion period of said pressure generating chamber in said second expanding step is no more than ½ Tc of the Helmholtz frequency of said pressure generating chamber.

26. The method of driving an ink jet printhead according to claim 23, in which a time period from application of a drive signal in said first contracting step to application of the drive signal in said second expanding step is no more than Tc of the Helmholtz frequency of said pressure generating chamber.

27. A method of driving an ink jet printhead in which when one of piezoelectric vibrators each associated with a pressure generating chamber, being communicatively connected to a nozzle orifice and a reservoir, is driven so that said pressure generating chamber is expanded or contracted to eject an ink drop through said nozzle orifice, said method comprising:

a first contracting step for ejecting an ink drop through said nozzle orifice by contracting said pressure generating chamber;

a hold step for holding the contraction state of said pressure generating chamber for a period of not more than ⅓ Tc, wherein Tc is the Helmholtz frequency of said pressure generating chamber;

a first expanding step for expanding said pressure generating chamber for a period of not more than ¼ Tc, wherein Tc is the Helmholtz frequency of said pressure generating chamber; and a second contracting step for contracting said pressure generating chamber so as to reduce a retraction of the ink meniscus occurring after said expanding step is executed.

28. A method of driving an ink jet printhead in which, when one of a plurality of piezoelectric vibrators, each associated with a pressure generating chamber, and being communicatively connected to a nozzle orifice and a reservoir, is driven so that said pressure generating chamber is expanded or contracted to eject an ink drop though said nozzle orifice, said method comprising:

a contracting step for contracting said pressure generating chamber so as to protrude a center region of a meniscus formed at said nozzle orifice; and an expanding step for examining said pressure generating chamber so as to extract a circumferential-end region of said meniscus having said center region protruded by said contracting step.

29. A method of driving an ink jet printhead in which, when one of a plurality piezoelectric vibrators each associated with a pressure generating chamber, and being comminicatively connected to a nozzle orifice and a reservoir, is driven so that said pressure generating chamber is expanded or contracted to eject an ink drop through said nozzle orifice, said method comprising:

a contracting step for contracting said pressure generating chamber so as to protrude a center region of a meniscus formed at said nozzle orifice; and an expanding step for expanding said pressure generating chamber, started during a period of said center region being protruded by said contracting step, said expanding step being performed in an expansion period of not more than 1/4 Tc of a Helmholtz frequency of said pressure generating chamber.

30. A method of driving an ink jet printhead in which, when one of plurality of piezoelectric vibrators, each associated with a pressure generating chamber, and being communicatively connected to a nozzle orifice and a reservoir, is driven so that said pressure generating chamber is expanded or contracted to eject an ink drop through said nozzle orifice, said method comprising:

a first contracting step for contracting said pressure generating chamber so as to protrude a center region of a meniscus formed at said nozzle orifice;

an expanding step for expanding said pressure generating chamber so as to extract a circumferential-end region of said meniscus having said center region protruded by said first contracting step; and a second contracting step for further contracting said pressure generating chamber so as to lower a level of said extraction of said circumferential-end region of said meniscus by said expanding step.

31. A method of driving an ink jet printhead in which, when one of a plurality of piezoelectric vibrators, each associated with a pressure generating chamber, and being communicatively connected to a nozzle orifice and a reservoir, is driven so that said pressure generating chamber is expanded or contracted to eject an ink drop through said nozzle orifice, said method comprising:

a first contracting step for contracting said pressure generating chamber so as to protrude a center region of a meniscus formed at said nozzle orifice;

an expanding step for expanding said pressure generating chamber, started during a period of said center region being protruded by said first contracting step, said expanding step being performed in an expansion period of not more than 1/4 Tc of a Helmholtz frequency of said pressure generating chamber; and a second contracting step for further contracting said pressure generating chamber so as to lower a level of said extraction of said circumferential-end region of said meniscus by said expanding step.

* * * * *